US011675384B2

(12) United States Patent
Wu

(10) Patent No.: US 11,675,384 B2
(45) Date of Patent: Jun. 13, 2023

(54) REFERENCE VOLTAGE GENERATOR WITH EXTENDED OPERATING TEMPERATURE RANGE

(71) Applicant: MACRONIX INTERNATIONAL CO., LTD., Hsinchu (TW)

(72) Inventor: Hsien-Hung Wu, Hsinchu (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 120 days.

(21) Appl. No.: 17/494,493

(22) Filed: Oct. 5, 2021

(65) Prior Publication Data

US 2023/0107389 A1 Apr. 6, 2023

(51) Int. Cl.
*G05F 3/26* (2006.01)

(52) U.S. Cl.
CPC ..... *G05F 3/262* (2013.01)

(58) Field of Classification Search
CPC . G05F 3/26; G05F 3/262; G05F 3/267; G05F 3/30
USPC ..... 323/313
See application file for complete search history.

(56) References Cited

U.S. PATENT DOCUMENTS 7,636,010 B2 * 12/2009 Huang ..... G05F 3/30 327/539
9,372,496 B2 * 6/2016 Arnold ..... G05F 3/267
9,811,104 B2 * 11/2017 Doorenbos ..... G05F 3/205
9,864,389 B1 * 1/2018 Vijaykumar ..... G05F 1/575
2016/0274616 A1 * 9/2016 Roy ..... G05F 3/267

FOREIGN PATENT DOCUMENTS

| | | | |
|---|---|---|---|
| CN | 100570527 | C | 12/2009 |
| CN | 102193578 | B | 7/2014 |
| CN | 107168442 | A | 9/2017 |
| CN | 107209528 | A | 9/2017 |
| CN | 108073215 | A | 5/2018 |
| EP | 0401280 | B1 | 11/1994 |

(Continued)

OTHER PUBLICATIONS

Andreou, et al., "A Novel Wide-Temperature-Range, 3.9 ppm/?C CMOS Bandgap Reference Circuit," in IEEE Journal of Solid-State Circuits, vol. 47, No. 2, Feb. 2012, pp. 574-581.

(Continued)

*Primary Examiner* — Yemane Mehari
(74) *Attorney, Agent, or Firm* — Andrew L. Dunlap; Haynes Beffel & Wolfeld LLP

(57) ABSTRACT

A reference voltage circuit includes a first circuit including a first PN junction device and a first resistor connected in series between a power supply node and a first node, and a second resistor connected between the first node and an intermediate node, and a third resistor connected between the intermediate node and a reference voltage output node, and a second circuit including a second PN junction device connected between the power supply node and a second node and a fourth resistor connected between the second node and the intermediate node. A feedback current causes voltage across the first resistor to offset changes in voltage across the first PN junction device. A correction current is applied to boost and or sink current in the voltage reference generator to extend the operating temperature range.

20 Claims, 18 Drawing Sheets

(56) References Cited

FOREIGN PATENT DOCUMENTS

| | | | |
|---|---|---|---|
| JP | 4647130 | B2 | 3/2011 |
| TW | 201804278 | A | 2/2018 |

OTHER PUBLICATIONS

Hu et al., "A Novel 1.03 ppm/° C. Wide-Temperature-Range Curvature-Compensated Bandgap Voltage Reference," 2018 IEEE 2nd International Conference on Circuits, System and Simulation (ICCSS), Jul. 2018, pp. 22-26.

Li, et al., "A Low Voltage Bandgap Reference Circuit with Current Feedback," EECS 413, as early as Jan. 2003, pp. 1-5.

* cited by examiner

FIG. 26
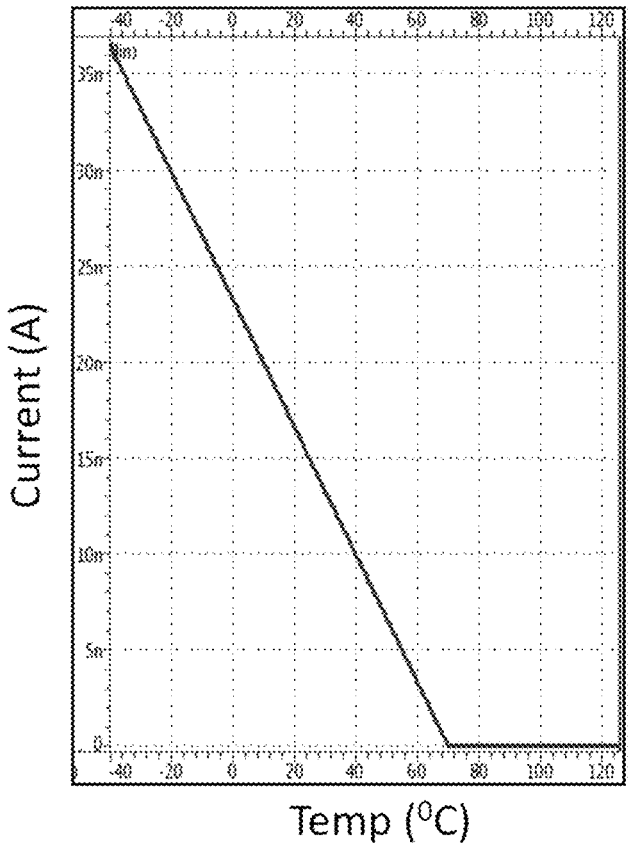
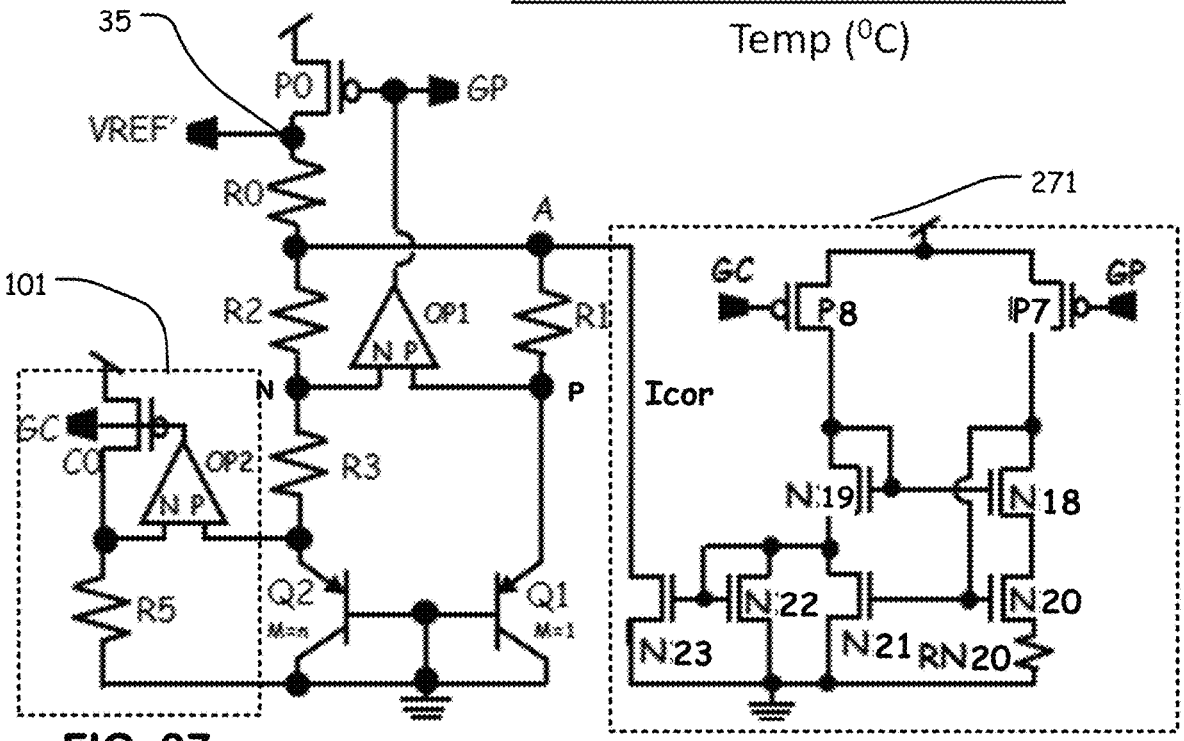
FIG. 27

REFERENCE VOLTAGE GENERATOR WITH EXTENDED OPERATING TEMPERATURE RANGE

BACKGROUND

Field

The present technology relates to reference voltage generators that maintain a constant reference voltage with very little change across a range of temperature, and more particularly to extending the operating range of temperature for such reference voltage generators.

Description of Related Art

Reference voltage generators are widely used in electronic circuits, including integrated circuits. It is desirable for such circuits to generate a reference voltage that changes very little with temperature. A bandgap reference circuit based on the bandgap voltage characteristics of PN junctions in PN junction devices, like diodes and transistors, is a common building block used in circuits for generating reference voltages. Bandgap reference circuits can maintain voltage reference value changes by only a few millivolts across an operating temperature range of, for example, 0° C. to 70° C. It is desirable to provide a technology that can extend the operating temperature range of reference voltage generators.

SUMMARY

Technology described herein can be applied to reduce the variations in reference voltage generated across an operating range of temperatures in reference voltage circuits, including bandgap reference circuits.

BRIEF DESCRIPTION OF THE DRAWINGS

FIG. 26 is a graph of a boosting correction current to correct for the skew shown in FIG. 2C.

FIG. 27 is a schematic diagram of a voltage reference generator including a current synthesizer to provide a boosting correction current as described with reference to FIG. 26.

DETAILED DESCRIPTION

A detailed description of embodiments of the present invention is provided with reference to the FIGS. 1-32.

Bandgap reference circuits have been developed which have two PN junction devices, such as transistors or diodes, arranged so that a difference in junction voltages (e.g. base-emitter voltage which is a function of bandgap voltage) between the two is developed across a resistor, with feedback to maintain a voltage drop across the resistor that offsets the changes in junction voltage with temperature.

Figure 1:
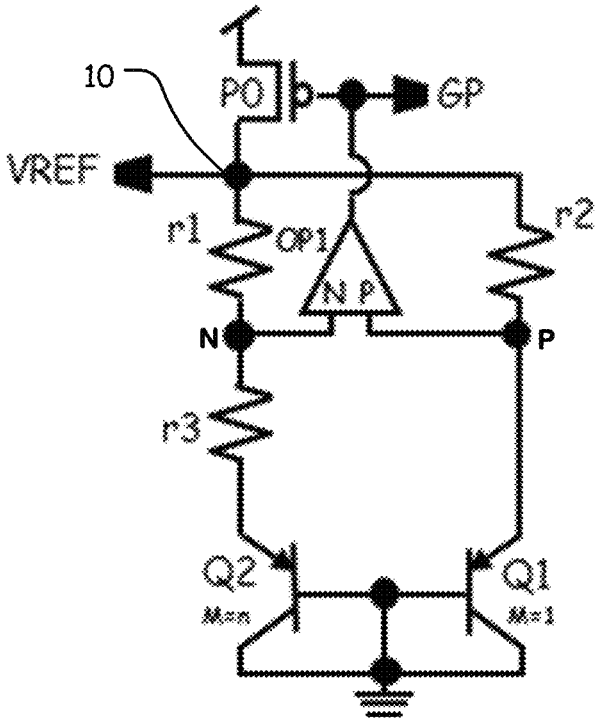
FIG. 1 is a schematic diagram of a bandgap reference voltage generator.

FIG. 1 is a schematic diagram of a bandgap reference circuit based on PNP transistors. The circuit includes PNP transistors Q1 and Q2, having their bases and collectors connected to ground, or other reference power supply node. The sizes of the transistors Q1 and Q2 differ. As labeled in FIG. 1, for Q2, M=n and for Q1, M=1, where "n" can be a multiple of the size of Q1. Q1 can be implemented by one transistor, Q2 can be implemented for example when "n" is an integer, by "n" identical transistors in parallel. For a given current magnitude, the current densities in Q1 and Q2 differ by the ratio of their sizes. A resistor r1 is connected between a node N and the reference voltage output node 10 at which voltage VREF is generated. A resistor r2 is connected between the emitter of transistor Q1 and the reference voltage output node 10 at which voltage VREF is generated. Also, the emitter of transistor Q1 is connected to a node P at the "plus" input of an operational amplifier OP1, so that the base-emitter voltage of Q1 is applied at node P. A resistor r3 is connected between the emitter of transistor Q2 and the node N, which is connected to the "negative" input of the operational amplifier OP1. A P-channel MOS transistor P0 is connected between the reference voltage output node 10 and a power supply potential, such as VDD or other reference power supply node. The output of the operational amplifier OP1 is connected to the gate of the P-channel MOS transistor P0 in feedback so that the difference in base-emitter voltage between Q1 and Q2 is developed across the resistor r3.

The base-emitter voltage VBE of a bipolar transistor like Q1, and thus the voltage at node P, has a negative temperature coefficient at least in the first order approximation, and therefore has magnitude having a complementary to absolute temperature CTAT characteristic. The difference in base-emitter voltages ΔVBE, and thus the voltage Vr3 across resistor r3 in this configuration, has a positive temperature coefficient at least in the first order approximation, and is therefore has magnitude having a proportional to absolute temperature PTAT characteristic.

A CTAT current or CTAT voltage as used herein is a current or voltage having a magnitude with a negative temperature coefficient at least in the first order approximation across the pertinent operating range of temperatures. A PTAT current or PTAT voltage as used herein is a current or voltage having a magnitude with a positive temperature coefficient at least in the first order approximation across the pertinent operating range of temperatures.

Thus, as a result of the feedback, the operational amplifier OP1 maintains the voltage at node N (equal to the base-emitter voltage of Q1) at node P. The values of the resistors r1 and r2 are typically equal, so that the voltages between the reference voltage output node 10 and the nodes N and P are equal. Therefore, the difference in base-emitter voltages VBE between the transistors Q1 and Q2 is offset by the voltage across resistor r3, as induced by the current through resistor r3. As the base-emitter voltage VBE of transistor Q1 varies in a manner that is complementary to absolute temperature CTAT, the operational amplifier develops the voltage at node GP to induce a current that is proportional to absolute temperature PTAT so that the voltage across r3 is equal to the difference in base-emitter voltages. So, as temperature increases, VBE of Q1 decreases and ΔVBE increases. The feedback increases the current across r3 to track the increase in ΔVBE. The increase in current also increases the voltage across r1 and r2 to compensate for decreasing VBE of Q1. The same balancing of CTAT and PTAT voltages holds true for decreasing temperatures. As a result, the voltage VREF can be relatively constant across a range of operating temperatures.

Figure 2A:
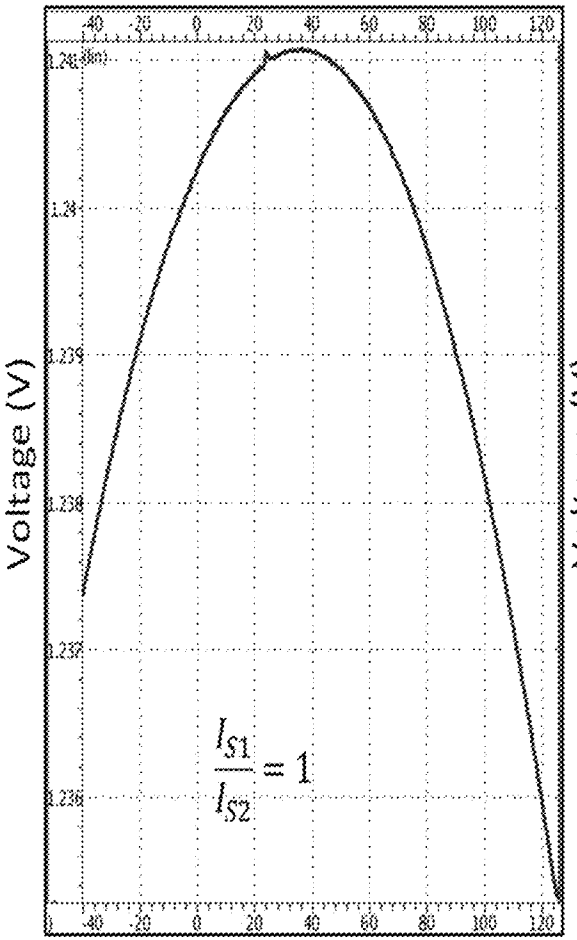
FIGS. 2A-2C plot reference voltage versus temperature for a circuit like that of FIG. 1 for different conditions of saturation current in the transistors Q1 and Q2.
Figure 2B:
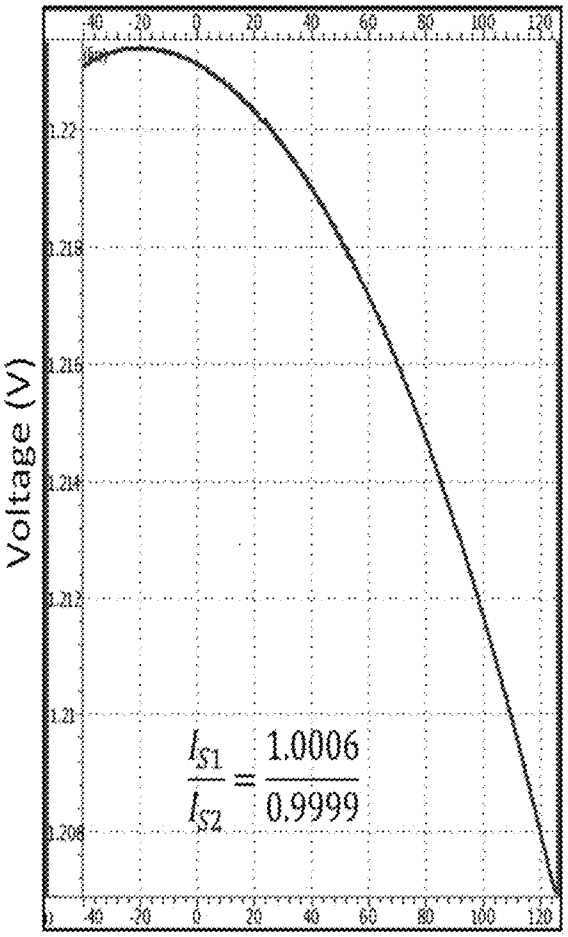
Figure 2C:
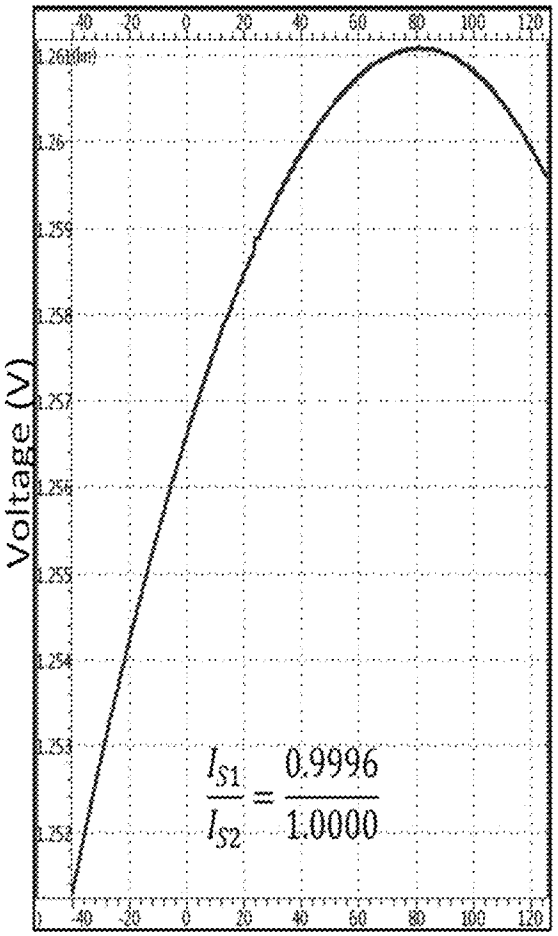

FIGS. 2A to 2C are graphs of simulated VREF voltage versus temperature for a bandgap reference circuit like that of FIG. 1, for three conditions in the ratio of saturation current IS1 in transistor Q1 and saturation current IS2 in transistor Q2. Table 1 shows a comparison of the graphs.

TABLE 1

| VREF(v) | FIG. 2A | FIG. 2B | FIG. 2C |
|---|---|---|---|
| 125° C. | 1.235 | 1.207 | 1.260 |
| 70° C. | 1.240 | 1.216 | 1.261 |
| 0° C. | 1.240 | 1.221 | 1.257 |
| −40° C. | 1.237 | 1.221 | 1.251 |
| Δ | 5.8E−03 | 1.4E−02 | 9.8E−03 |

In FIG. 2A, the ratio IS1/IS2 equals 1. In this well-balanced condition, as shown in Table 1, the voltage at 0° C. and the voltage at 70° C. is equal at 1.240 V. However, as the temperature exceeds 70° up to 125°, the voltage drops to about 1.235 V; and as the temperature falls below 0° C. down to about −40° C., the voltage drops to about 1.237 V. As a result, the variation across the range from −40° to 125° is about 5.8 mV.

FIG. 2B illustrates a condition in which the saturation current IS1 exceeds the saturation current IS2 by small amounts. In FIG. 2B, the ratio is 1.0006/0.9999. As seen, this shifts the peak of the voltage curve downward to lower temperatures and results in a larger variation in VREF. As seen in Table 1, for the condition of FIG. 2B, the variation across the range from −40° to 125° C. is about 14 mV. However, the curve is relatively symmetrical around a peak at about 35° C.

FIG. 2C illustrates a condition in which the saturation current IS1 is smaller than the saturation current IS2 by small amounts. In FIG. 2B, the ratio is 0.9996/1.0000. As seen, this shifts the peak of the voltage curve upward to higher temperatures and results in a larger variation in VREF. As seen in Table 1, for the condition of FIG. 2C, the variation across the range from −40° to 125° is about 9.8 mV.

Note that in the typical operating temperatures from 0° C. to 70° C., VREF varies by 5 mV or less in all three graphs. However, as the temperature ranges are extended to −40° C. and +125° C., the VREF falls off substantially.

Figure 3:
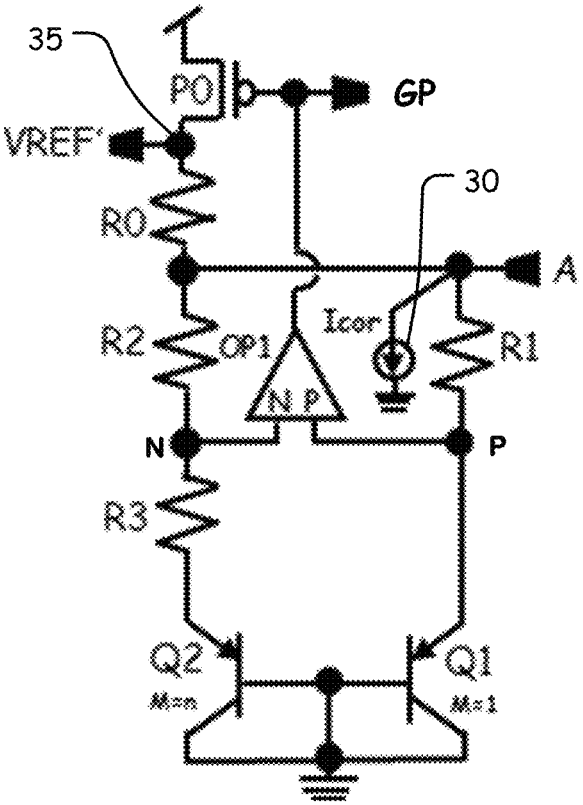
FIG. 3 is a schematic diagram of a bandgap reference voltage generator including a source of boosting correction current to extend the operating temperature range of the circuit.

FIG. 3 is a schematic diagram of a reference voltage circuit having an extended range of operating temperatures, adding a current source 30 which generates a correction current Icor to compensate for the tendency of VREF to fall off substantially in the extended temperature ranges in a bandgap reference voltage circuit like that of FIG. 1. The circuit includes a first circuit and a second circuit including PNP transistors Q1 and Q2, respectively, having their base and collector connected to a power supply potential (e.g. VSS or ground). The sizes of the transistors Q1 and Q2 differ (for Q2, M=n and for Q1, M=1) so that for a given current magnitude, the current densities differ by the ratio of their sizes. A resistor R3 is connected between the emitter of transistor Q2 and a node N at the "negative" input of the operational amplifier OP1. A resistor R2 is connected between the node N and an intermediate node A. A resistor R0 is connected between the intermediate node A and the reference voltage output node 35 at which voltage VREF' is generated. A resistor R1 is connected between the emitter of transistor Q1 and the intermediate node A. Also, the emitter of transistor Q1 is connected to a node P at the "plus" input of the operational amplifier OP1, so that the base-emitter voltage of Q1 is applied at node P. A P-channel MOS transistor P0 is connected between the reference voltage output node 35' and a power supply potential (e.g. VDD or other power supply potential). The output GP of the operational amplifier OP1 (which has a PTAT characteristic) is connected to the gate of the P-channel MOS transistor P0 in feedback so that the difference in base-emitter voltage between Q1 and Q2 is developed across the resistor R3.

In order to extend the range of operating temperatures, a correction current Icor is applied from a current source 30 at the intermediate node A. The correction current can increase the current across resistor R0 to extend operating temperature ranges across temperature thresholds, such as below 0° C. and above 70° C. An implementation can be applied to extend the operating range below 0° C. An implementation can be applied to extend the operating range above 70° C., alone or in combination with a correction extending the operating range below 0° C. An implementation can also be applied to correct for variations in the ratio of saturation current as described with reference to FIG. 2A to 2C, alone or in combination with the other corrections which extend the temperature range.

In the circuit of FIG. 3, the current IQ2 in transistor Q2 depends only on the negative feedback circuit, and does not depend on current IR0 through the resistor R0.

Derivations of the reference voltage VREF as a function of currents in the circuit are summarized in the following equations (1) to (3):

$$\text{By negative feedback.} \tag{1}$$

$$V_n = V_p$$

$$\text{or } I_{Q2}R_3 + V_{EB2} = V_{EB1}$$

$$\text{Besides } \Delta V(A, V_p) = \Delta V(A, V_n) \tag{2}$$

$$\text{or } V_{R1} = V_{R2}$$

$$\text{if } R_1 = R_2 \text{ then } I_{R1} = I_{R2}.$$

$$\text{Because } I_{R2} = I_{R3} = I_{Q2} \text{ and } I_{R1} = I_{Q1},$$

$$\text{therefore } I_{R1} = I_{Q1} = I_{Q2} = I_{R3}.$$

$$\text{and } I_{R0} = I_{R1} + I_{R2} = 2I_{R1} = 2I_{Q2}$$

$$\begin{aligned} VREF &= V_{EB1} + V_{R1} + V_{R0} \\ &= V_{EB1} + I_{R1} \times R_1 + I_{R0} \times R_0 \\ &= V_{EB1} + I_{R1} \times R_1 + 2I_{R1} \times R_0 \\ &= V_{EB1} + I_{R1} \times (R_1 + 2 \times R_0) \\ &= V_{EB1} + I_{Q2} \times (R_1 + 2 \times R_0) \end{aligned} \tag{3}$$

$$\text{By superposition } I'_{R0} = I_{R0} + I_{cor} \tag{4}$$

$$\text{and } V'_{R0} = I'_{R0} \times R_0 = V_{R0} + I_{cor} \times R_0$$

$$\text{Because } V_{EB1}, V_{R1} \text{ are independent of } I_{cor}$$

$$\begin{aligned} VREF' &= V_{EB1} + V_{R1} + V'_{R0} \\ &= V_{EB1} + V_{R1} + V_{R0} + I_{cor} \times R_0 \\ &= VREF + I_{cor} \times R_0 \end{aligned}$$

The only voltage changes that result from adding the correction current Icor at the intermediate node A occur in VR0 across the resistor R0 and in the reference voltage VREF' at the output node 35, as derived in equation (4) above. The addition of the resistor R0 and the current source 30 can be used to reduce the variation in the reference voltage VREF illustrated in FIG. 2A. For example, the operating temperature range can be extended to −40° C. in some cases, to 125° C. in some cases, and across the entire range of −40° C. to 125° C.

Figure 4:
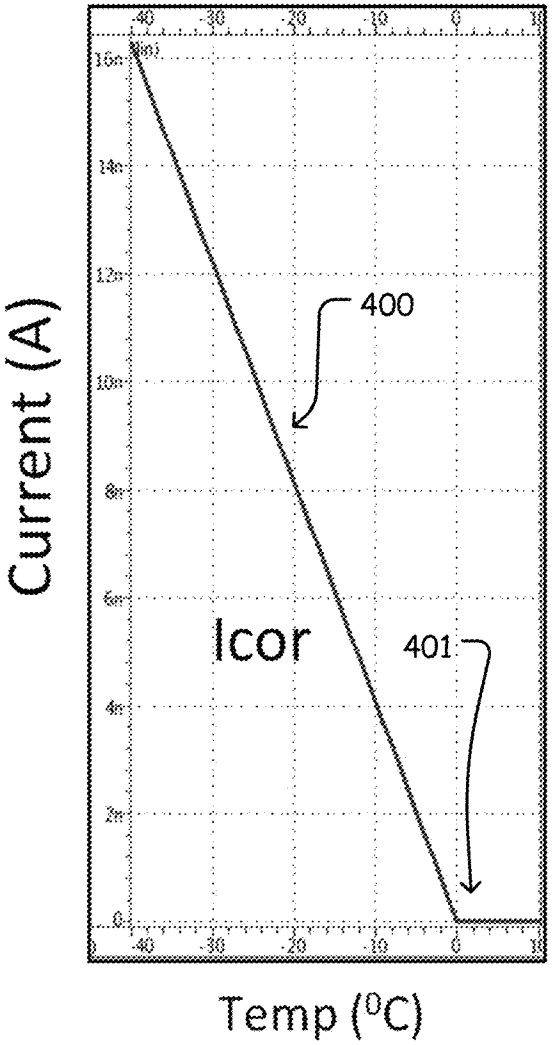
FIG. 4 is a graph of a synthesized correction current which can extend the operating temperature range below 40° C.
Figure 5:
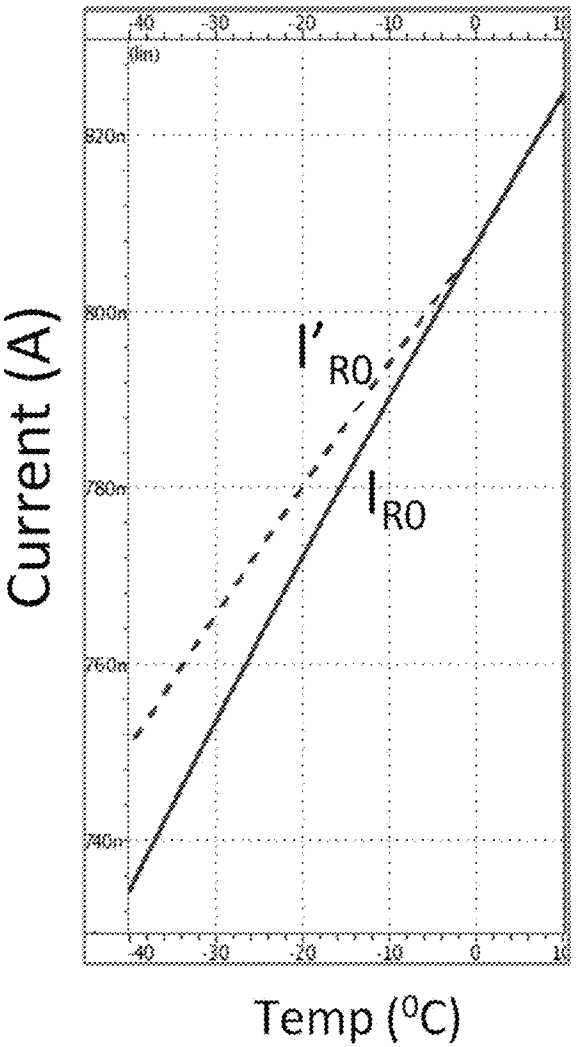
FIG. 5 plots corrected and uncorrected current through the resistor R0 in the circuit of FIG. 3.
Figure 6:
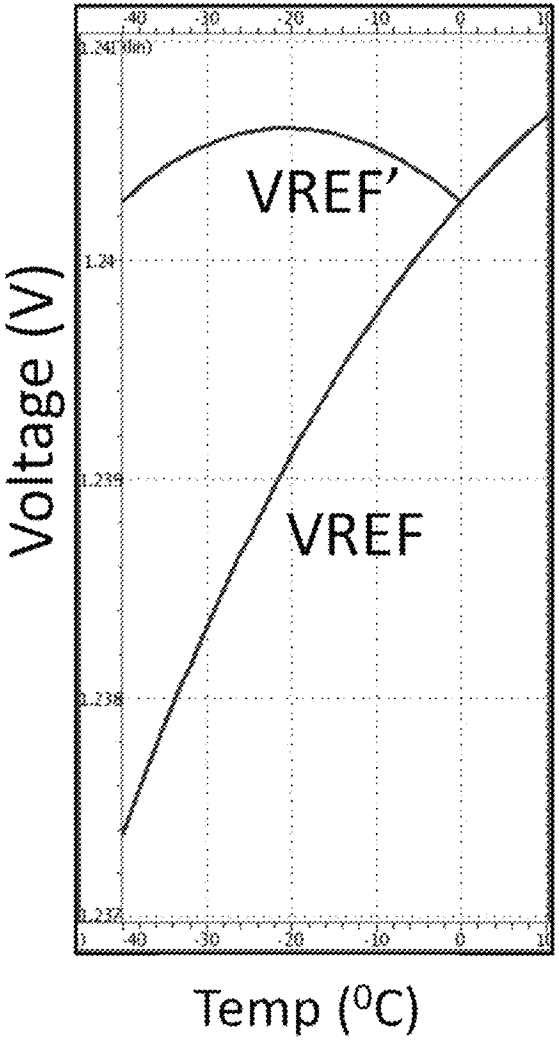
FIG. 6 plots corrected and uncorrected reference voltage VREF applying the correction current of FIG. 4.

FIGS. 4 through 6 are graphs of current or voltage versus temperature, illustrating the effect of adding a correction current Icor to compensate for the fall of VREF below 0° C. in the graph of FIG. 2A. As illustrated in FIG. 4, a correction current Icor is applied to boost current in the resistor R0 at operating temperatures on a first side of a threshold, that is below 0° C., and to turn off at operating temperatures on an opposite, second side of the threshold, that is above 0° C. In this example, the correction current Icor has a CTAT characteristic, falling from about 16 nano amps to zero as temperature increases in a range from about −40° C. to about 0° C. At the threshold of 0° C., the correction current Icor is off, at least to the extent that it does not have a significant effect on the output voltage VREF above 0° C.

FIG. 5 illustrates the effect on the correction current Icor through the resistor R0 circuit of FIG. 3. The lower trace in FIG. 5 illustrates the current IR0 through the resistor R0 without the addition of the correction current Icor. The current IR0 has a PTAT characteristic, falling from about 825 nano amps to about 730 nano amps as the temperature falls from about 10° C. to about −40° C. The upper trace in FIG. 5 illustrates the current IR0' with the addition of the correction current shown in FIG. 4. As seen, as the temperature falls below the threshold of about 0° C., the correction current causes IR0' to be slightly larger than IR0, with an increasing margin as temperature falls relative to IR0.

FIG. 6 illustrates a result on the output voltage VREF' of the addition of the correction current Icor of FIG. 4. The lower trace in FIG. 6 plots the reference voltage VREF simulated without the addition of the correction current Icor. As seen, it falls off from a level above 1.24 V to a level about 1.2374 V as the temperature falls from about 0° C. to about −40° C. With the addition of the correction current Icor, the reference voltage VREF', shown in the upper trace of FIG. 6, is held within a narrow range, extending the effective operating temperature range of the reference voltage circuit down to −40° C. or to even more negative temperatures.

The operating principal described with reference to FIGS. 4-6 can also be used to increase the operating temperature range above 70° C., for example. A correction current Icor can be applied to boost current in the resistor R0 at operating temperatures on a first side of a threshold, that is above 70° C., and to turn off at operating temperatures on an opposite, second side of the threshold, that is below 0° C. For example, a correction current Icor can be applied that has a PTAT characteristic above the threshold of 70° C. to compensate for the tendency of the reference voltage VREF to fall off rapidly above 70° C. Also, as described herein, the correction current can be a combination of currents designed to compensate for variations in the reference voltage with temperature in both higher and lower extensions of the operating temperature ranges.

It is also desirable for the cases in which the ratio of saturation currents IS1 and IS2 is not equal to one, to compensate for the shift in the VREF versus temperature shown in FIGS. 2B and 2C. In the condition of FIG. 2C, the ratio of the saturation currents IS1 and IS2 is less than one. As seen in FIG. 2C, the peak of the voltage of the reference is shifted to a higher operating temperature causing asymmetry in the graph so that VREF falls off within a range of 0° C. to 70° C. Compensation for this condition requires addition of a CTAT correction current across the operating range that can raise VREF in the lower part of the temperature range. This can be accomplished by adding a CTAT correction current across R0 to the intermediate node A using current source 30 as discussed in more detail below.

Figure 7:
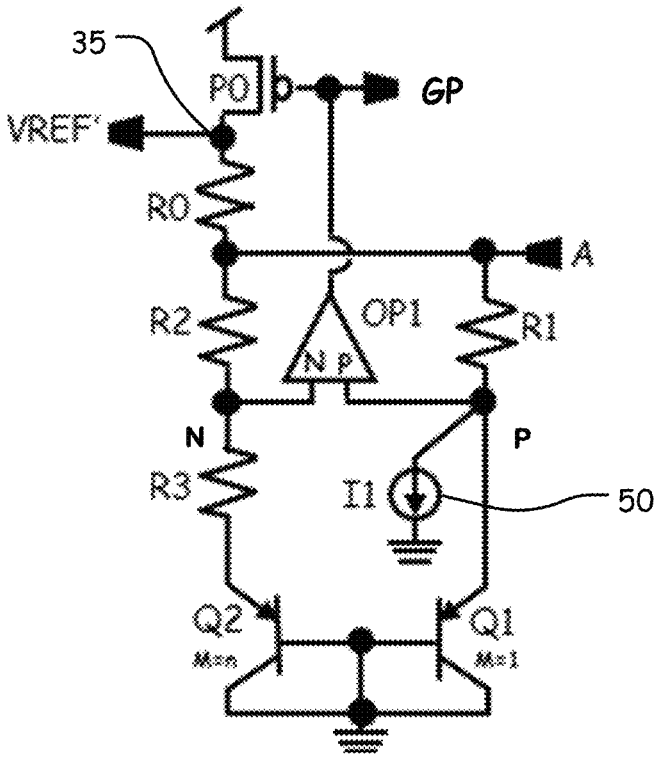
FIG. 7 is a schematic diagram of a bandgap reference voltage generator including a source of sinking correction current to correct for imbalance in the reference voltage produced.

FIG. 7 is a schematic diagram of a reference voltage circuit adding a current source 50 which generates a correction current I1 to compensate for the condition of FIG. 2B, in which the ratio of the saturation currents IS1 and IS2 is more than one. As seen in FIG. 2B, the peak of the voltage of the reference is shifted to a lower operating temperature causing asymmetry in the graph so that VREF rises up within a range of 0° C. to 70° C. Compensation for this condition requires sinking a CTAT correction current that reduces the current IQ1 in transistor Q1. A circuit for accomplishing this compensation is shown in FIG. 7.

The circuit in FIG. 7 includes a first circuit and a second circuit including PNP transistors Q1 and Q2, respectively, having their base and collector connected to a power supply potential (e.g. VSS or ground). The sizes of the transistors Q1 and Q2 differ (for Q2, M=n and for Q1, M=1) so that for a given current magnitude, the current densities differ by the ratio of their sizes. A resistor R3 is connected between the emitter of transistor Q2 and a node N at the "negative" input of the operational amplifier OP1. A resistor R2 is connected between the node N and an intermediate node A. A resistor R0 is connected between the intermediate node A and the reference voltage output node 35 at which voltage VREF' is generated. A resistor R1 is connected between the emitter of transistor Q1 and the intermediate node A. Also, the emitter of transistor Q1 is connected to a node P at the "plus" input of the operational amplifier OP1, so that the base-emitter voltage of Q1 is applied at node P. A P-channel MOS transistor P0 is connected between the reference voltage output node 35 and a power supply potential (e.g. VDD). The output of the operational amplifier OP1 is connected to the gate of the P-channel MOS transistor P0 in feedback so that the difference in base-emitter voltage between the Q1 and Q2 is developed across the resistor R3.

In this implementation, the current source 50 is added to sink current I1 from the node P, which reduces the current in transistor Q1. This reduction current lowers the resulting VREF. As demonstrated by the equations below, the current source 50 which sinks I1 from node P does not affect the feedback operation of the operational amplifier OP1. As seen in equation (5), the current IQ2 depends on the ratio of IQ1/IQ2. Thus, when the correction current I1 is nonzero, IQ1 becomes less than IQ2, and the second term in equation (5) becomes a negative constant. As a result, sinking the current I1 from node P causes IQ2 to get smaller relative to the case in which I1=0.

$$\text{Given } V_{EB1} = V_T \ln(I_{Q1}/I_{S1}) V_{EB2} = V_T \ln(I_{Q2}/nI_{S2}) \tag{5}$$

(1) could be rewritten as:

$$I_{Q2}R_3 + V_T \ln(I_{Q2}/nI_{S2}) = V_T \ln(I_{Q1}/I_{S1})$$

$$\begin{aligned} I_{Q2}R_3 &= V_T[\ln(I_{Q1}/I_{S1}) - \ln(I_{Q2}/nI_{S2})] \\ &= V_T\{\ln[(nI_{S2}/I_{S1}) \times (I_{Q1}/I_{Q2})]\} \\ &= V_T[\ln(nI_{S2}/I_{S1}) + \ln(I_{Q1}/I_{Q2})] \end{aligned}$$

Figure 8:
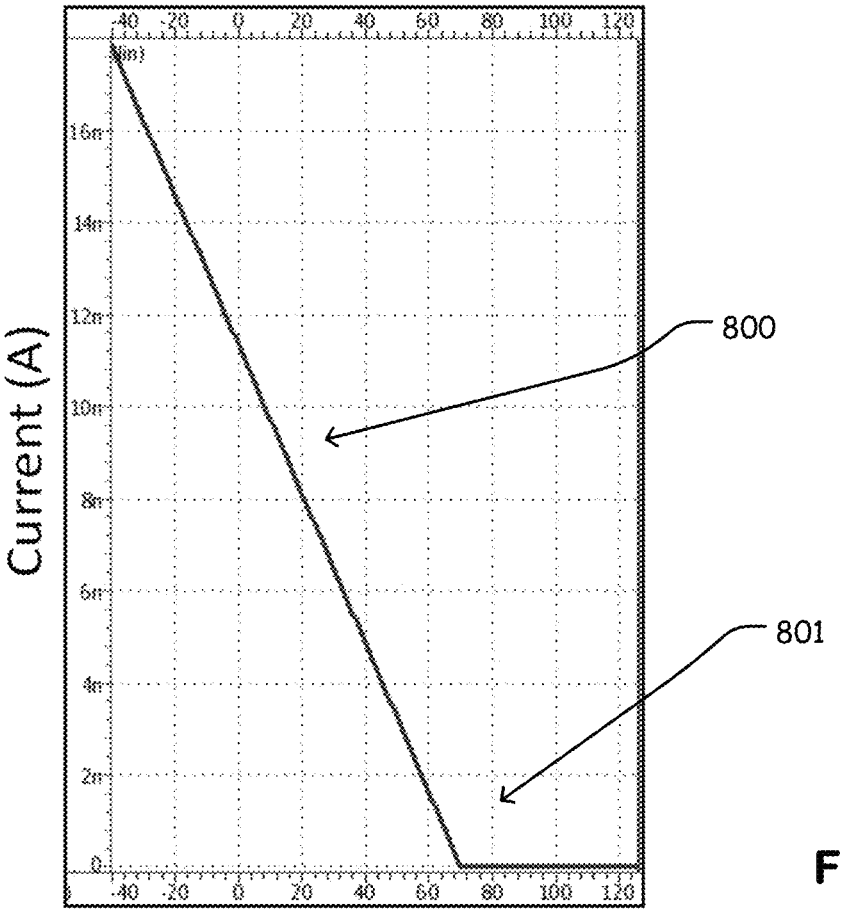
FIG. 8 is a graph of the size correction current which can be used to shift the voltage reference plot of FIG. 2B.

-continued $$I_{Q2} = (V_T/R_3) \times [\ln(nI_{S2}/I_{S1}) + \ln(I_{Q1}/I_{Q2})]$$

because $V_{R1} = V_{R2}$ and $R1 = R2$ then $I_{R1} = I_{R2}$ or $I_1 + I_{Q1} = I_{Q2}$ if $I_1 = 0{:}I_{Q1} = I_{Q2}$ or $\ln(I_{Q1}/I_{Q2}) = 0$ if $I_1 > 0{:}I_{Q1} < I_{Q2}$ or $\ln(I_{Q1}/I_{Q2}) < 0$ therefore if $I_1 = 0{:}I_{Q2} = (V_T/R_3) \times [\ln(nI_{S2}/I_{S1})]$ if $I_1 > 0{:}I_{Q2} = (V_T/R_3) \times [\ln(nI_{S2}/I_{S1}) - \text{constant}]$ FIG. 8 is a graph of current versus temperature for an example correction current I1. In this example, the correction current I1 has a CTAT characteristic in the region 800 below the threshold of about 70° C., the region 800 having a temperature range from about −40° C. to positive 70° C., and turns off on the other side of the threshold in the region 801 above 70° C.

Figure 9:
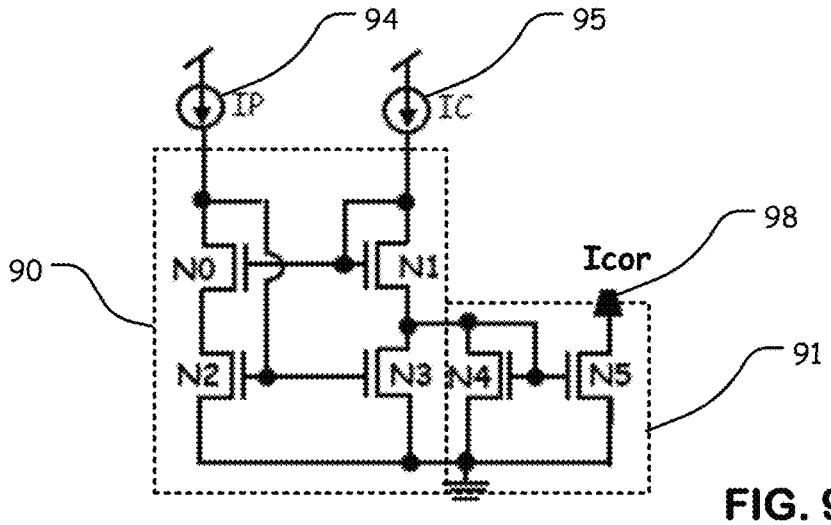
FIG. 9 is a schematic diagram of a current subtracter and current attenuator which can be used to produce correction current as described herein.

FIG. 9 is a schematic diagram of a current source that can be utilized to provide a correction current Icor having characteristics as described above. In this embodiment, the current source comprises current synthesizer including a current subtracter 90 followed by a current attenuator 91. The current subtracter 90 includes NMOS transistors NO to N3. Transistors N0 and N2 are connected in series between ground and a first current source 94 which applies a current IP. The gate of transistor N2 is connected to the drain of transistor N0. Transistors N1 and N3 are connected in series between ground and a second current source 95 which applies current IC. The gate of transistor N1 is connected to its drain. Because of the current mirror effect of transistors N2 and N3, the difference between the currents IP and IC is applied to the drain of NMOS transistor N4 of the current attenuator 91. The current attenuator 91 includes a second NMOS transistor N5 configured in a current mirror relationship with transistor N4. Correction current Icor is generated at the drain 98 of transistor N5. By setting the ratio of the sizes of N5 to N4 to a desired value below 1, the magnitude of the correction current Icor can be determined as needed. Also, in this circuit, when the current (IC in this example) through transistor N3 falls below the current in transistor N2 (IP in this example) in magnitude, transistor N4 turns off, so Icor is also turned off, or essentially so.

Correction currents Icor or I1 as described above can be implemented such that they have a CTAT or a PTAT characteristic across the relevant operating range. One technique for creating a CTAT characteristic of the current in the circuit in FIG. 9 is to apply a current IC having a CTAT characteristic and a current IP having a PTAT characteristic, where the current IC has a greater magnitude across the relevant operating range, and the magnitudes cross at the temperature threshold. Likewise, a technique for creating a PTAT characteristic of the current in the circuit of FIG. 9 is to apply a current IC having a CTAT characteristic and a current IP having a PTAT characteristic, where the current IP has a greater magnitude across the relevant operating range, and the magnitudes cross at the temperature threshold.

Figure 10:
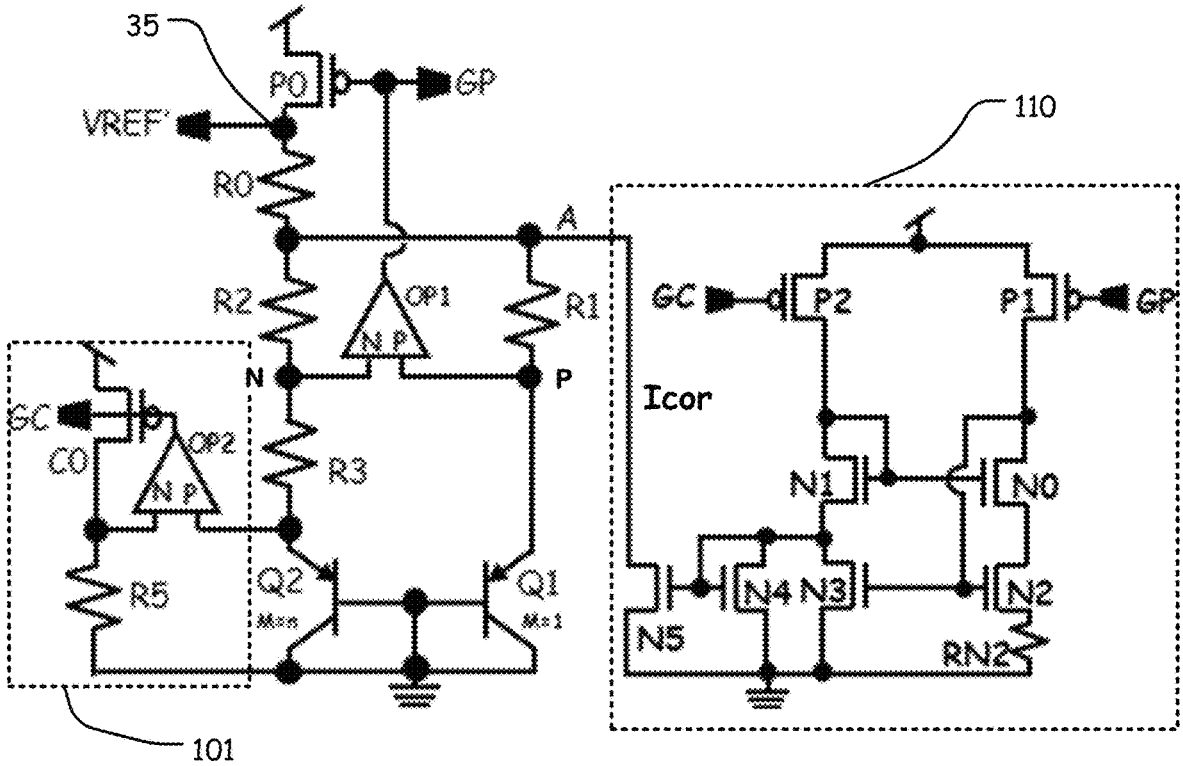
FIG. 10 is a schematic diagram of a voltage reference generator including a current synthesizer like that of FIG. 9 which can correct the voltage reference in the lower temperature ranges.

FIG. 10 illustrates an embodiment of a voltage reference generator using a current synthesizer 110 used as a current source to generate the current Icor. The current synthesizer 110 has a configuration like that of FIG. 9. The current subtracter includes NMOS transistors N0 to N3 and resistor RN2. Transistors N0 and N2 and resistor RN2 are connected in series between ground and a first PMOS transistor P1, having a gate connected to the control voltage GP. The gate of transistor N2 is connected to the drain of transistor N0. The control voltage GP in this example is generated at the output of the operational amplifier OP1 in the bandgap voltage reference generator, and therefore produces a current in transistor P1 having a PTAT characteristic. Transistors N1 and N3 are connected in series between ground and PMOS transistor P1, having a gate connected to the control voltage GC. The gate of transistor N1 is connected to the gate of transistor N0. Also, the gate of transistor N1 is connected to its drain. The control voltage GC in this example is generated by a CTAT reference circuit 101 which is configured to produce the voltage GC having a CTAT characteristic. As a result, the current in transistor P2 has a CTAT characteristic.

Because of the current mirror effect of transistors N2 and N3, the difference between the currents IN1 and IN2 is applied to the drain of NMOS transistor N4 of the current attenuator. A second NMOS transistor N5 is configured in a current mirror relationship with transistor N4. Correction current Icor is generated at the drain 98 of transistor N5, and applied to the intermediate node A of the voltage reference generator. By setting the ratio of the sizes of N5 to N4 to a desired value below 1, the magnitude of the correction current Icor can be determined as needed.

The CTAT reference circuit 101 in this example includes a resistor R5 and a PMOS transistor CO in series between ground and VDD (or other power supply potential). Also, a second operational amplifier OP2 in the circuit 101 has a "plus" input connected to the emitter of transistor Q2 and a "minus" input connected to resistor R5. The operational amplifier OP generates an output voltage GC that maintains the current in the PMOS transistor CO at a value that establishes a voltage across the resistor R5 matching the base-emitter voltage VBE of the transistor Q2. The circuit 101 operates without affecting the operation of the bandgap reference circuit feedback using the first operational amplifier OP1. As a result, the transistor P2 in the current synthesizer 110 produces a current having a CTAT characteristic.

In operation, the circuit in FIG. 10 generates a CTAT current in transistor N1 and a PTAT current in transistors N0 and N2. The PTAT current in transistors N0 and N2 carrying a magnitude (IR0/3) that is equal to one third the magnitude of the current across resistor R0, realized by the current mirror effect in transistor P1 from transistor P0 being fed through transistors N0 and N2, and mirrored in transistor N3. The resistor RN2 is tunable or set to modify the ratio of currents IN3/IN2 in transistors N3 and N2.

Figure 11:
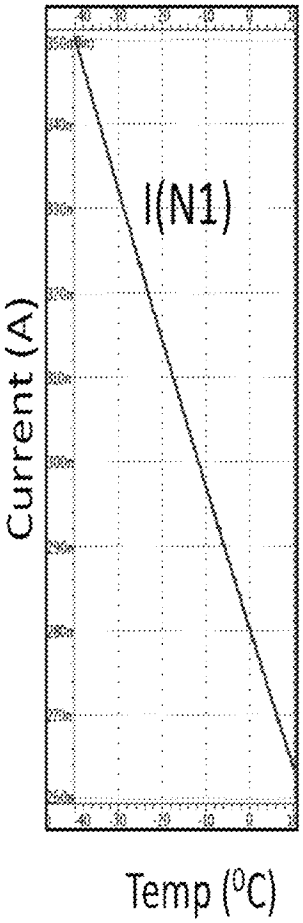
FIG. 11 is a plot of current through transistor N1 in the circuit of FIG. 10 across temperature for the case in which RN2 is equal to zero.
Figure 12:
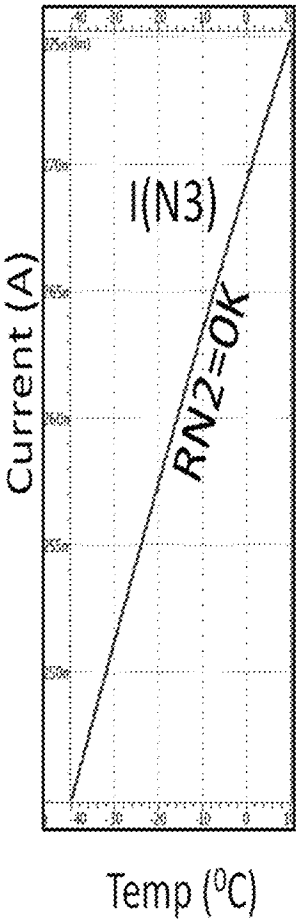
FIG. 12 is a plot of current through transistor N3 in the circuit of FIG. 10 across temperature for the case in which RN2 is equal to zero.

FIGS. 11 and 12 illustrate a simulated currents IN1 and IN3 for the case in which RN2 is 0 ohms. As illustrated, IN1 has a negative temperature coefficient (CTAT characteristic) in a range from about −40° C. to about +10° C. falling from about 350 nano amps to about 265 nano amps. IN3 on the other hand has a positive temperature coefficient (PTAT characteristic) across the range from about −40° C. to about +10° C. rising from about 240 nano amps to about 275 nano amps.

Figure 13:
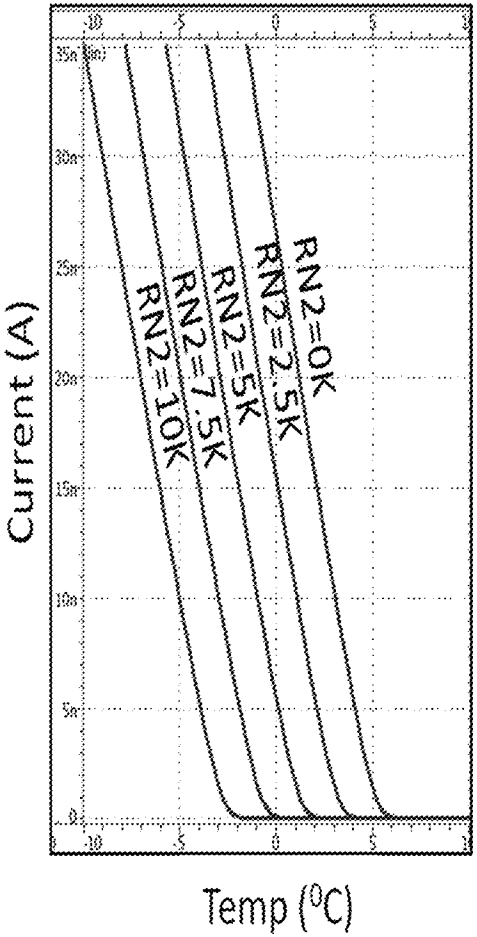
FIG. 13 is a simulation of changes in currents of transistor N4 of FIG. 10 for changes in the value of the resistor RN2 of FIG. 10.

In this simulation, IN1 is about equal to IN3 at 5° C., which is a higher temperature than the desired 0° C. cross point, at which it is desired to turn off the correction current Icor. However, increasing the size of resistor RN2 increases the ratio of IN3/IN2, establishing a larger PTAT subtrahend in the current subtraction circuit. In the circuit for example, increasing RN2 from about 0 ohms to about 10 kilo ohms makes to zero cross point move to lower temperatures as illustrated in FIG. 13. In this simulation, RN2 at 7.5 kilo ohms result in a zero crossing at about 0° C. Using RN2 at 7.5 kilo ohms, the resulting subtracted current is attenuated by the ratio of sizes of the transistors N5 and N4.

Figure 14:
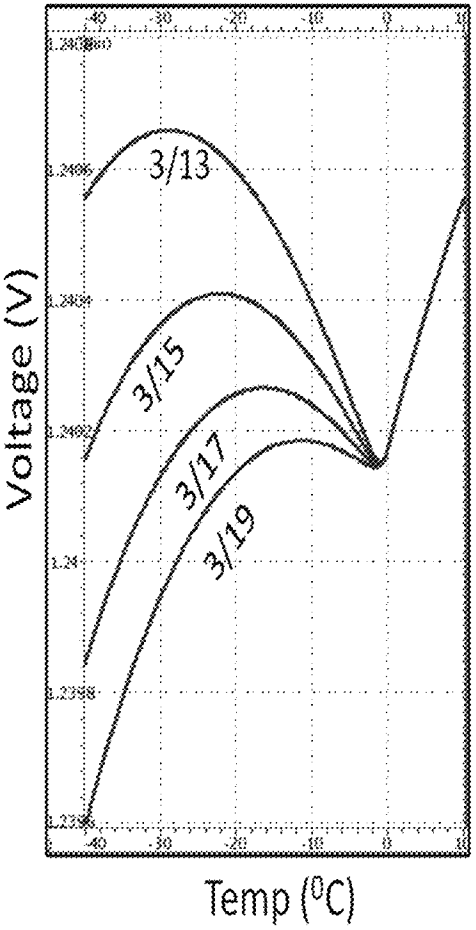
FIG. 14 is a plot of simulation of the voltage reference generated for variations in the value of ratio of sizes of transistors N4 and N5 of the circuit of FIG. 10.

In FIG. 14, the simulation results for N5/N4 size ratios of 3/13, 3/15, 3/17 and 3/19 are plotted. According to this simulation, for RN2 equal to 7.5 kilo ohms, and the N5/N4 ratio of 3/15, the variation in the output reference voltage VREF' is less than 0.1 mV across the temperature range of −40° C. to 0° C. (varying between about 1.24014 V to about 1.2404 V).

In a given implementation using technologies described herein, the slope and cross point of the Icor current can be tuned using these current synthesis techniques. Other embodiments can deploy other types of current synthesis circuits to generate desired correction current, Icor and I1, characteristics.

Figure 15:
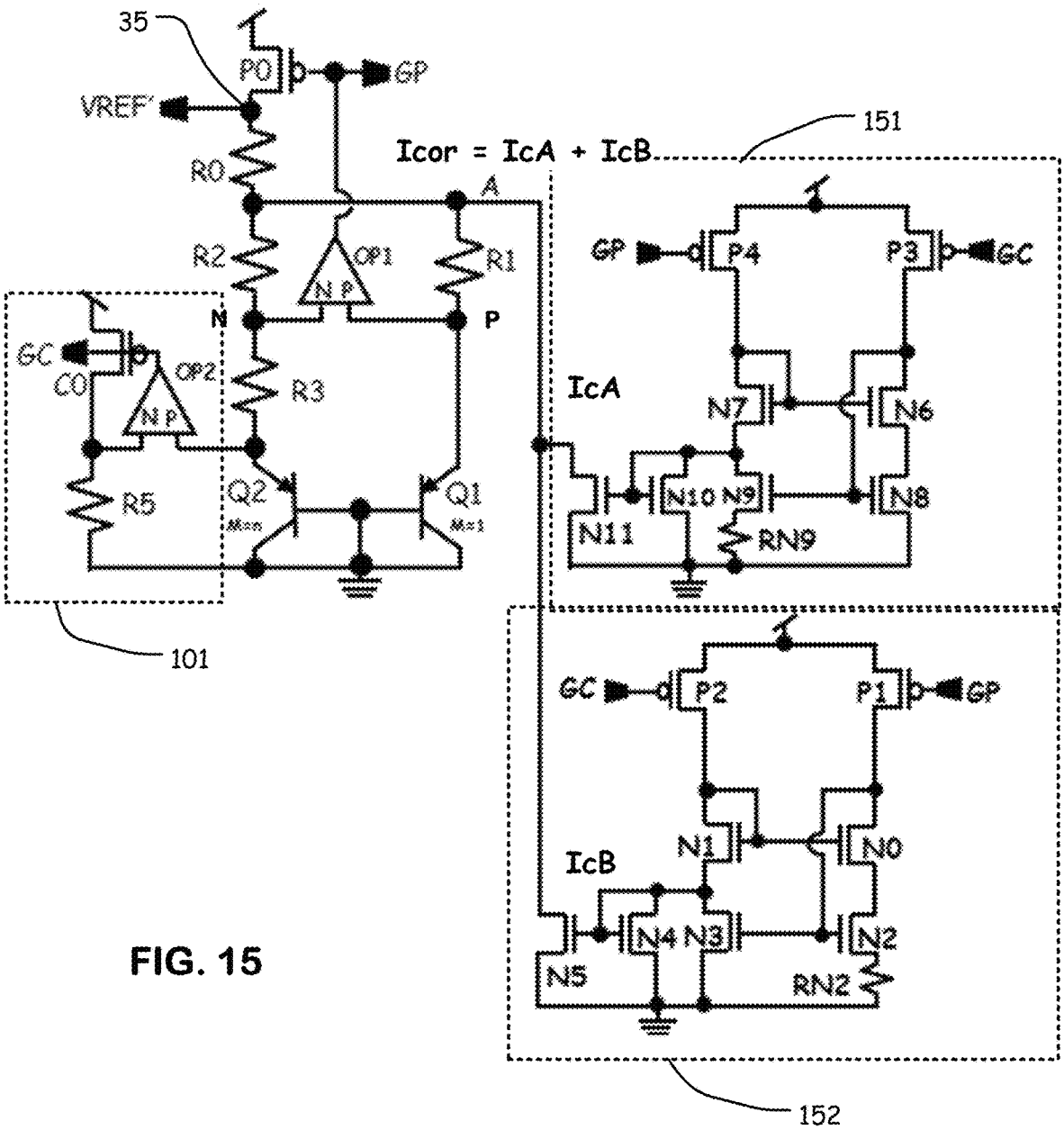
FIG. 15 is a schematic diagram of a voltage reference generator including two current synthesizers which can correct the voltage reference in the lower temperature ranges, and in the higher temperature ranges.

The embodiment described with reference to FIG. 10 provides a correction current Icor that extends the operating temperature range downward towards −40° C. or beyond. In FIG. 15, an example is described to extend the operating range both downwards towards −40° C. and beyond, and upwards towards 125° C. and beyond. In the example of FIG. 15, the correction current Icor is the sum of currents IcA and IcB which are generated by current synthesizers 151 and 152, respectively. The current synthesizer 152 of FIG. 15 is implemented as described above with reference to FIG. 10, and provides current IcA with a negative temperature coefficient below the threshold of about 0° C., and turns off at about 0° C.

The current synthesizer 152 of FIG. 15 generates a CTAT correction current IcB with a selected cutoff temperature, and includes a current subtracter and attenuator of the type used in the synthesizer 151. The current subtracter includes NMOS transistors N0 to N3 and resistor RN2. Transistors N0 and N2 and resistor RN2 are connected in series between ground and a first PMOS transistor P1, having a gate connected to the control voltage GP. The gate of transistor N2 is connected to the drain of transistor N0. The control voltage GP in this example is generated at the output of the operational amplifier OP1 in the bandgap voltage reference generator, and therefore produces a current in transistor P1 having a PTAT characteristic. Transistors N1 and N3 are connected in series between ground and PMOS transistor P1, having a gate connected to the control voltage GC. The gate of transistor N1 is connected to the gate of transistor N0. Also, the gate of transistor N1 is connected to its drain. The control voltage GC in this example is generated by a CTAT reference circuit 101 which is configured to produce the voltage GC having a CTAT characteristic. As a result, the current in transistor P2 has a CTAT characteristic.

Because of the current mirror effect of transistors N2 and N3, the difference between the currents IN1 and IN2 is applied to the drain of NMOS transistor N4 of the current attenuator. A second NMOS transistor N5 is configured in a current mirror relationship with transistor N4. Correction current Icor is generated at the drain of transistor N5, and applied to the intermediate node A of the voltage reference generator. By setting the ratio of the sizes of N5 to N4 to a desired value below 1, and by selecting the resistance of resistor RN2, the magnitude and cutoff threshold of the CTAT correction current IcB can be determined as needed.

The current synthesizer 151 of FIG. 15 generates a PTAT correction current IcA with a selected cutoff temperature, and includes a current subtracter and attenuator. The current subtracter includes NMOS transistors N6 to N9 and resistor RN9. Transistors N6 and N8 are connected in series between ground and a third PMOS transistor P3, having a gate connected to the control voltage GC. The gate of transistor N8 is connected to the drain of transistor N6. The control voltage GC in this example is generated by the CTAT reference circuit 101, and therefore produces a current in transistor P3 having a CTAT characteristic. Transistors N7 and N9, and resistor RN9 are connected in series between ground and a fourth PMOS transistor P4, having a gate connected to the control voltage GP, generated at the output of the operational amplifier OP1 in the bandgap voltage reference generator. The gate of transistor N7 is connected to the gate of transistor N6. Also, the gate of transistor N7 is connected to its drain. In response to the control voltage GP, the current in transistor P4 has a PTAT characteristic.

Because of the current mirror effect of transistors N9 and N8, the difference between the currents IN7 and IN8 is applied to the drain of NMOS transistor N10 of the current attenuator. A second NMOS transistor N11 is configured in a current mirror relationship with transistor N10. Correction current Icor is generated at the drain of transistor N11, and applied to the intermediate node A of the voltage reference generator. By setting the ratio of the sizes of N10 to N11 to a desired value below 1, and by selecting the resistance of resistor RN9, the magnitude and cutoff threshold of the PTAT correction current IcA can be determined as needed.

Figure 16:
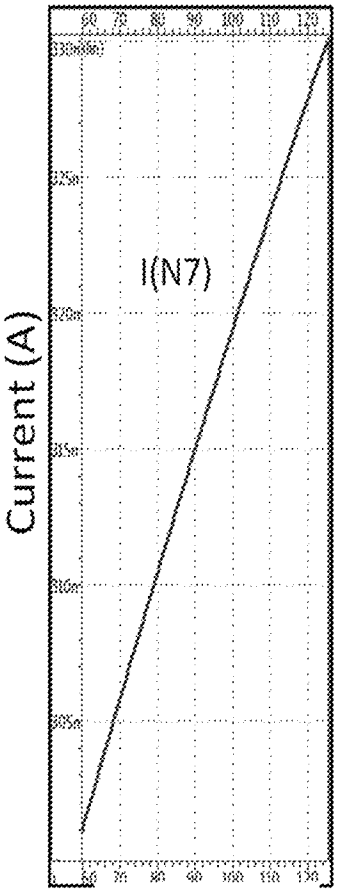
FIG. 16 is a graph of current versus temperature in transistor N7 of FIG. 15.
Figure 17:
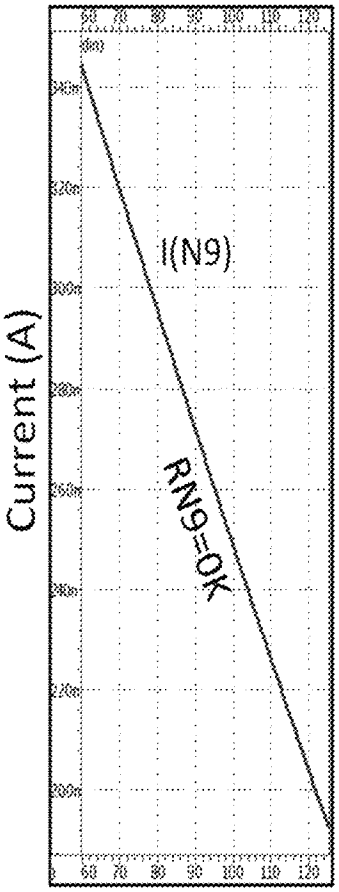
FIG. 17 is a graph of current versus temperature in transistor N9 of FIG. 15.

FIGS. 16 and 17 illustrate simulated currents IN7 and IN9 for the case in which RN9 is 0 ohms. As illustrated, IN7 has a positive temperature coefficient (PTAT characteristic) in a range from about +60° C. to about +125° C. increasing from about 301 nano amps to about 330 nano amps. IN9 on the other hand has a negative temperature coefficient (CTAT characteristic) across the range from about +60° C. to about +125° C. falling about 341 nano amps to about 195 nano amps.

Figure 18:
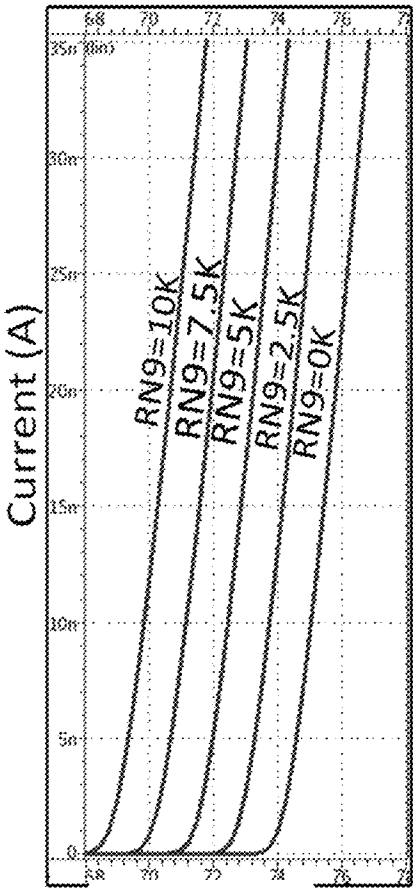
FIG. 18 is a graph of current versus temperature in transistor N10 of FIG. 15 at different values of resistance for resistor RN9 of FIG. 15.

In this simulation, IN7 is about equal to IN9 (308 nano amps) at 74° C., which is a higher temperature than the desired 70° C. cross point, below which it is desired to turn off the correction current IcA. However, increasing the size of resistor RN9 decreases the ratio of IN9/IN8, establishing a smaller CTAT subtrahend in the current subtraction circuit. In the circuit for example, increasing RN9 makes the zero cross point move to lower temperatures as illustrated in FIG. 18. In this simulation, RN9 at 7.5 kilo ohms result in a zero crossing at about 70° C. Using RN9 at 7.5 kilo ohms, the resulting subtracted current is attenuated by the ratio of sizes of the transistors N5 and N4.

Figure 19:
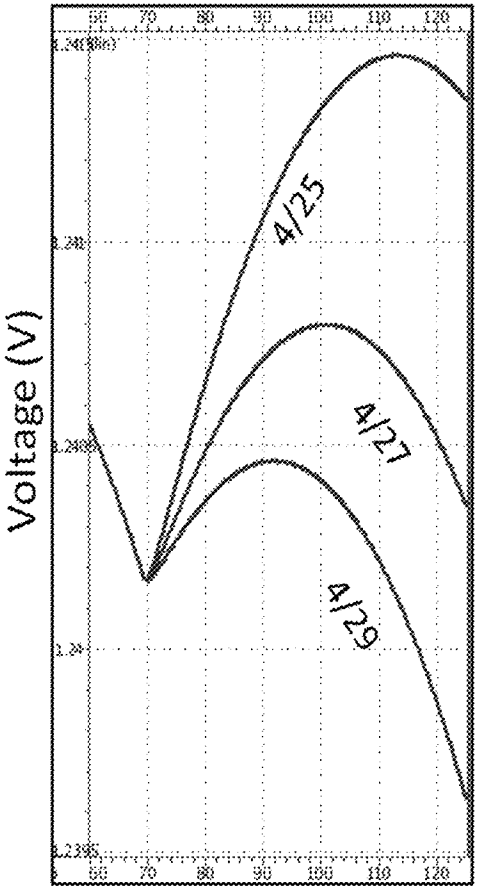
FIG. 19 is a graph showing VREF versus temperature across a higher temperature range for different current attenuation conditions in the circuit of FIG. 15.

In FIG. 19, the simulation results for N11/N10 size ratios of 4/25, 4/27 and 4/29 are plotted. According to this simulation, for RN9 equal to 7.5 kilo ohms, and the N11/N10 ratio of 4/27, the variation in the output reference voltage VREF' is less than 0.2 mV across the temperature range of +70° C. to about +125° C. (varying between about 1.24015 V to about 1.24035 V).

Figure 20:
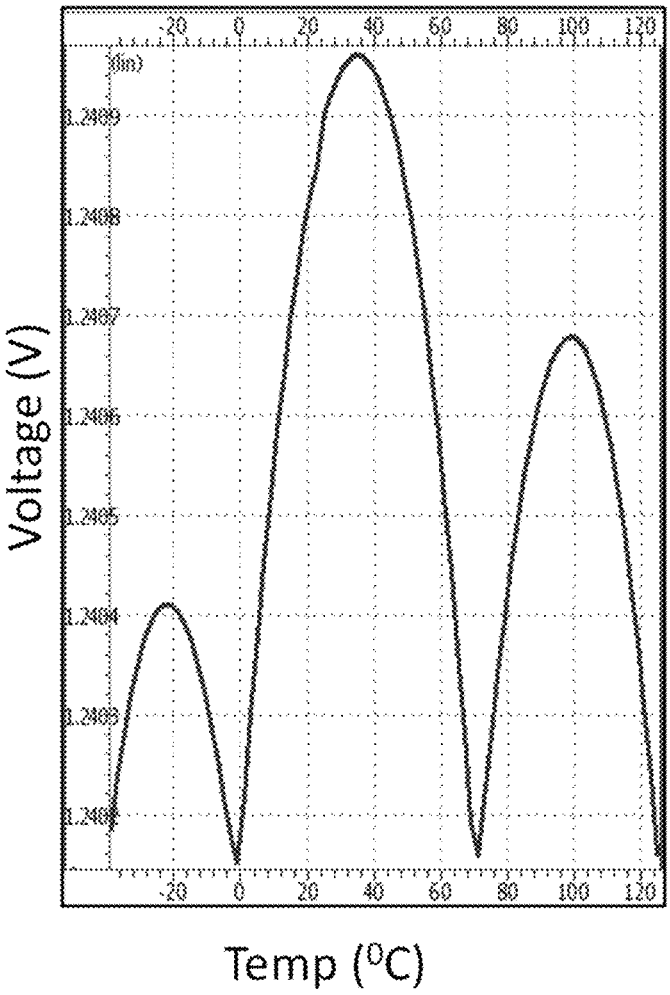
FIG. 20 is a graph of VREF across an extended temperature range using the circuits of FIG. 15 and FIG. 10.

FIG. 20 illustrates results of simulation of a circuit like that of FIG. 15 across the extended operating temperature range of −40° C. to positive 125° C. Within this range, VREF varies from a minimum of about 1.24016 V at about 0° C., to a maximum of about 1.24098 at about 35° C. As a result of technologies described herein, the bandgap reference voltage has an extended operating temperature range, within which the variation in VREF is about 1 mV, or smaller.

As mentioned above with reference to FIG. 7 and FIG. 8, the saturation current IS1 of transistor Q1 and the reference voltage generator may not match the saturation current IS2 of transistor Q2, due for example to variations in the fabrication. In these circumstances, the reference voltage VREF generated may be skewed or shifted around the normal operating temperatures as shown in FIGS. 2B and 2C. A technology is described to remove this skew or shift, in order to improve the ability to utilize the correction current to extend the operating temperature ranges as discussed above. Take for example a reference voltage at 70° C. about 1.216 V as illustrated in FIG. 2B while the reference voltage at 0° C. is about 1.221 V. The reference voltage at 0° C. should be lowered by about 5 mV in order to compensate for the shift. As mentioned above, unlike boosting the current through resistor R0 to boost VREF, reducing VREF requires lowering the PTAT currents IQ1 and IQ2 in the transistors Q1 and Q2, respectively. This can be accomplished by sinking the current I1 at the emitter of Q1 as illustrated in FIGS. 7 and 8.

Figure 21:
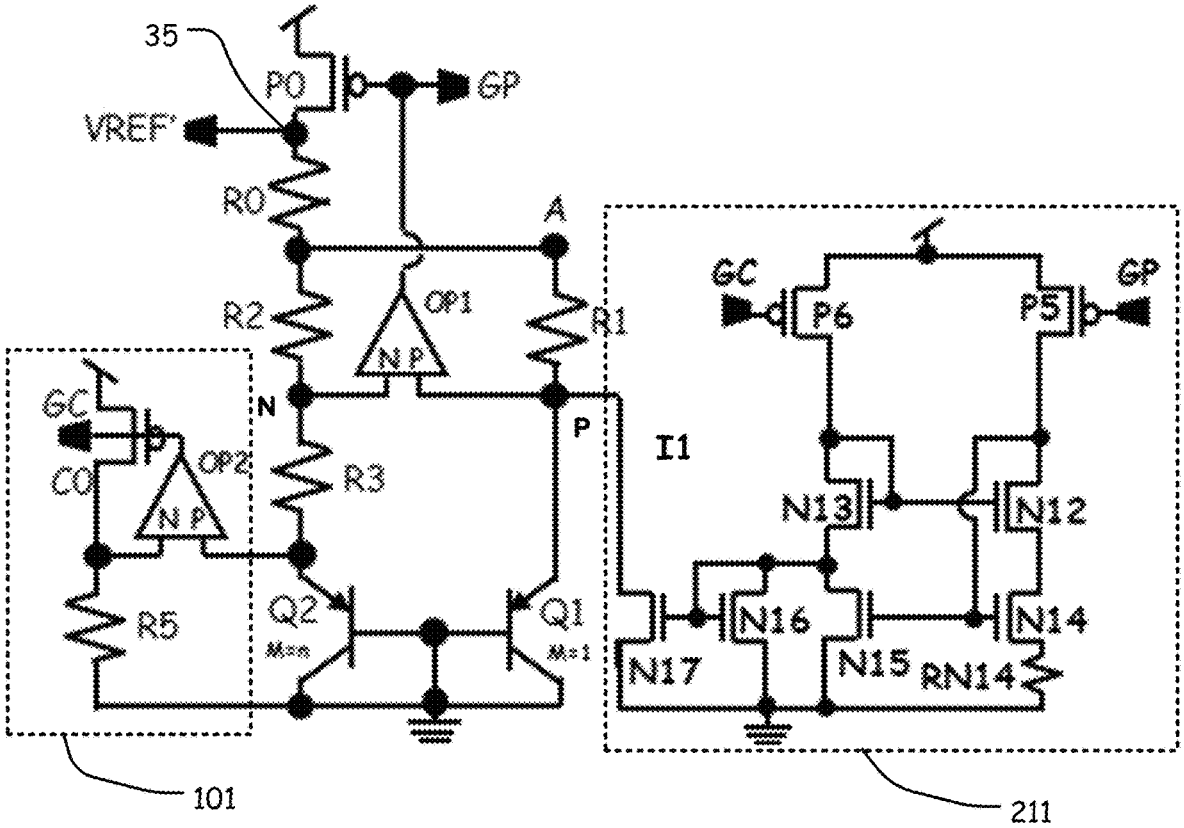
FIG. 21 is a schematic diagram of a voltage reference generator including a current synthesizer to provide a sinking correction current as described with reference to FIG. 7.

FIG. 21 illustrates the voltage reference generator including a current synthesizer 211 to generate current I1 like that shown in FIG. 8. The current synthesizer 211 of FIG. 21 generates a CTAT correction current I1 with a selected cutoff temperature of about 70° C., and includes a current subtracter and attenuator. The current subtracter includes NMOS transistors N12 to N15 and resistor RN14. Transistors N12 and N14 and resistor RN14 are connected in series between ground and a PMOS transistor P5, having a gate connected to the control voltage GP. The gate of transistor N14 is connected to the drain of transistor N12. The control voltage GP in this example is generated at the output of the operational amplifier OP1 in the bandgap voltage reference generator, and therefore produces a current in transistor P5 having a PTAT characteristic. Transistors N13 and N15 are connected in series between ground and a PMOS transistor P6, having a gate connected to the control voltage GC, in this example generated by the CTAT reference circuit 101, and therefore produces a current in transistor P6 having a CTAT characteristic. The gate of transistor N15 is connected to the gate of transistor N14. Also, the gate of transistor N13 is connected to its drain.

Because of the current mirror effect of transistors N14 and N15, the difference between the currents IN13 and IN14 is applied to the drain of NMOS transistor N16 of the current attenuator. A second NMOS transistor N17 is configured in a current mirror relationship with transistor N16. Correction current I1 is generated at the drain of transistor N17, and applied to the node P of the voltage reference generator. By setting the ratio of the sizes of N17 to N16 to a desired value below 1, and by selecting the resistance of resistor RN14, the magnitude and cutoff threshold of the CTAT correction current I1 can be determined as needed, such as shown in FIG. 8.

Figure 22:
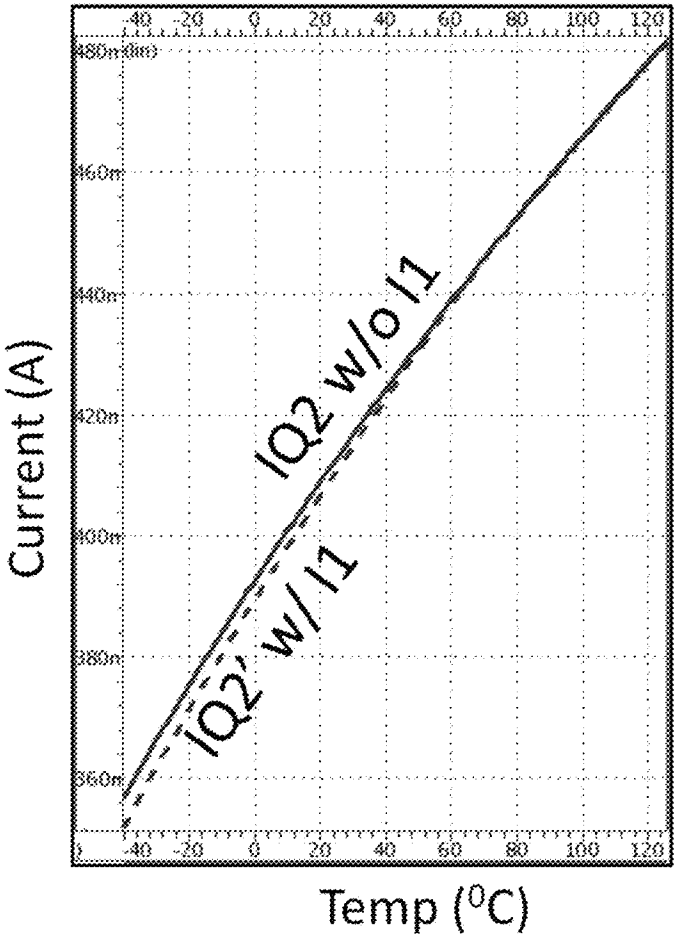
FIG. 22 is a graph of current in transistor Q2 for the circuit in FIG. 21 with and without the correction current.

FIG. 22 is a graph of current IQ2 in transistor Q2 without the correction current I1 and current IQ2' in transistor Q2 with the sinking correction current I1 generated by simulating a circuit like that described with reference to FIG. 21 to synthesize a current as shown in FIG. 8.

Figure 23:
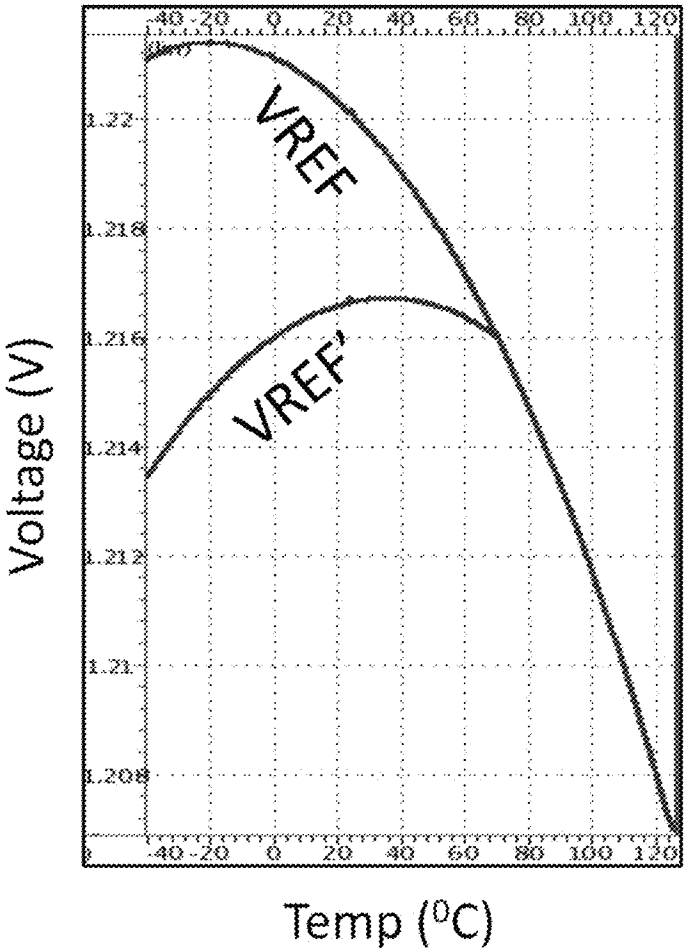
FIG. 23 is a graph of VREF for the circuit of FIG. 21, with and without the correction current.

FIG. 23 is a plot of the reference voltage VREF without the sinking correction current I1, and VREF' with the sinking correction current I1 with the characteristics of FIG. 8.

As illustrated in FIG. 8, the sinking correction current I1 has a maximum value of about 18 nano amps at −40° C. and falls to about zero nano amps at 70° C., where it is cut off. According to the simulation, as seen in FIG. 22, a sinking correction current of about 11.3 nano amps at 0° C. can reduce IQ2 by about three nano amps. As the sinking current I1 increases towards the values at −40° C., VREF' continues to fall slightly through the range, and improves equalization of VREF' between 0° C. and 70° C. This can result in a plot of VREF' in FIG. 23 similar to that of FIG. 2A, which is more symmetrical, and more easily corrected using the correction currents above 70° C. and below 0° C. as described herein.

Figure 24:
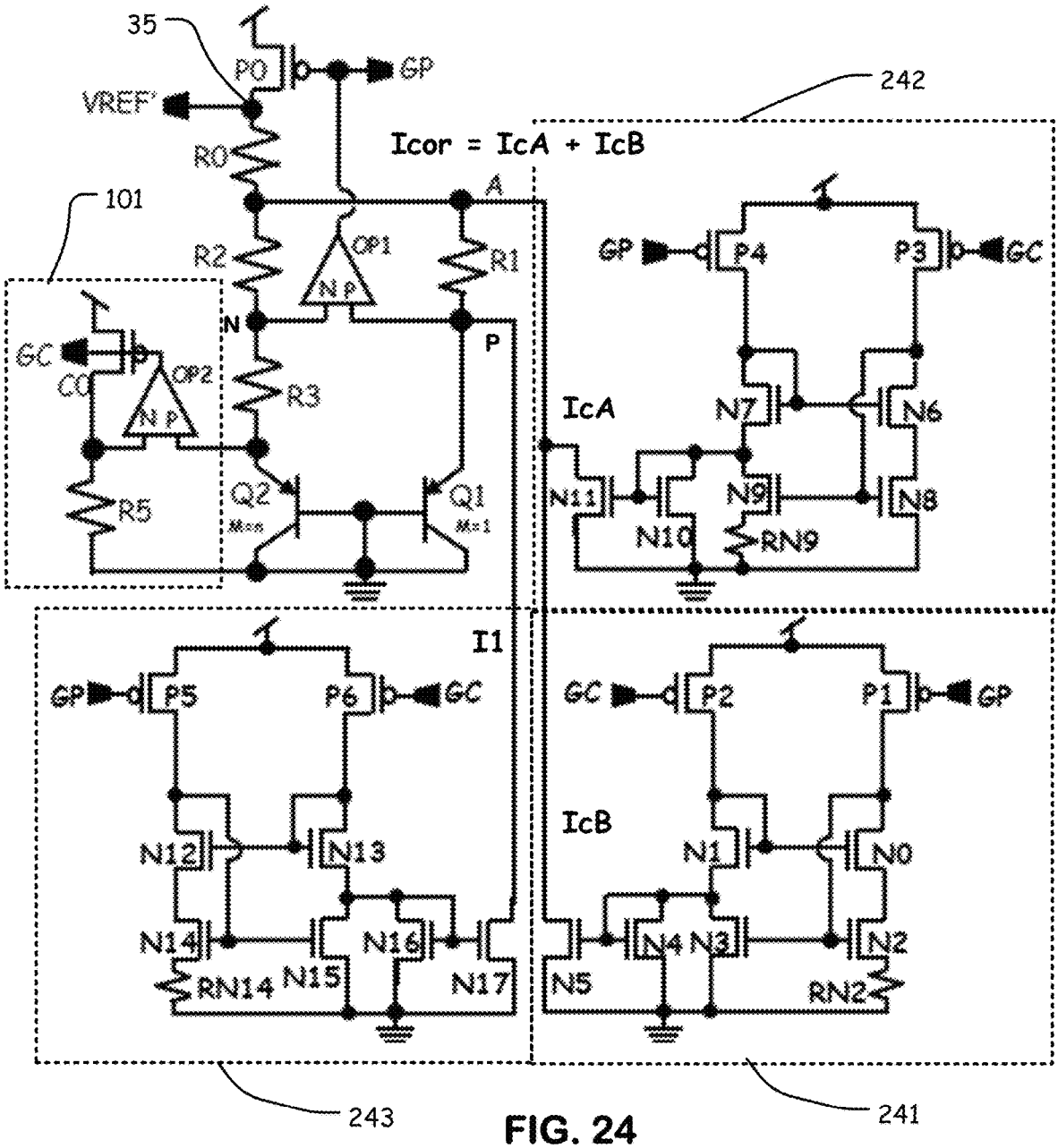
FIG. 24 is a schematic diagram of a voltage reference generator including two current synthesizers which can correct the voltage reference in the lower temperature ranges, and in the higher temperature ranges, and a current synthesizer to produce a sinking correction current.

FIG. 24 is a diagram of a voltage reference generator combining the technologies described with reference to FIGS. 15 and 21. The circuit includes a sinking correction current synthesizer 243 like that of FIG. 21 to generate the sinking correction current I1 applied to the node P, a boosting correction current synthesizer 242 like synthesizer 151 of FIG. 15 to generate boosting correction current IcA, and a boosting current synthesizer 241 like synthesizer 152 of FIG. 15 to generate the boosting correction current IcB.

Figure 25:
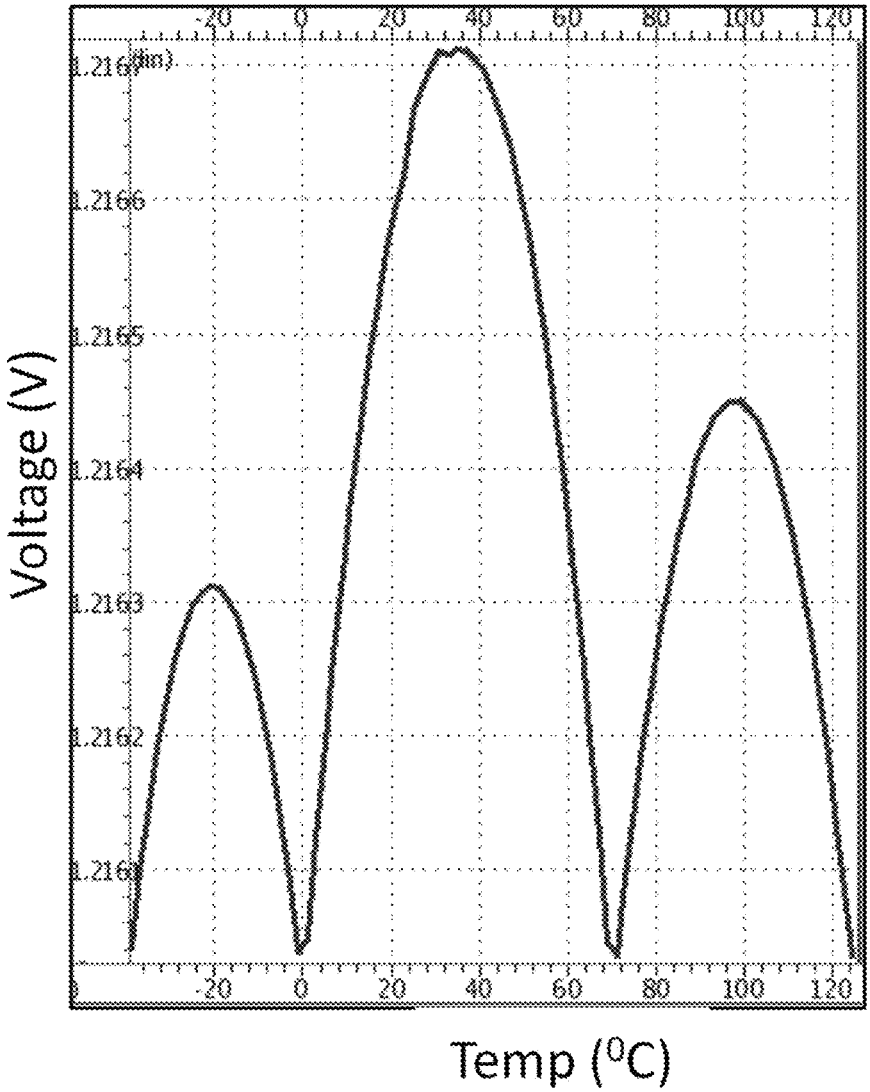
FIG. 25 is a graph of VREF across an extended temperature range using the circuits of FIG. 24, FIG. 21 and FIG. 15.

FIG. 25 is a plot of the reference voltage VREF generated using a circuit like that of FIG. 24 across the range of about −40° C. to about 125° C., ranging less than 1 mV across the extended operating temperature range, from a peak of about 1.21671 at around 35° C. to a minimum of about 1.21604 at about 70° C.

As shown in FIG. 2C, in the case in which the saturation current ratio IS1/IS2 is less than one, the reference voltage VREF is shifted or skewed such that the voltage at 0° C. is about 4 mV lower than the voltage at about 70° C. To remove this difference, a boosting correction current as illustrated in FIG. 26 can be applied to the intermediate node A to boost the reference voltage generated at the lower temperatures. The boosting correction current Icor of FIG. 26 has a negative temperature coefficient (CTAT characteristic) with a maximum of about 36 nano amps at −40° C. falling to about zero nano amps at 70° C. where it is cut off.

FIG. 27 illustrates the voltage reference generator including a correction current synthesizer to generate a boosting correction current as shown in FIG. 26. The current synthesizer 271 of FIG. 27 generates a CTAT boosting correction current Icor with a selected cutoff temperature of about 70° C., and includes a current subtracter and attenuator. The current subtracter includes NMOS transistors N18 to N21 and resistor RN20. Transistors N18 and N20 and resistor RN20 are connected in series between ground and a PMOS transistor P7, having a gate connected to the control voltage GP. The gate of transistor N20 is connected to the drain of transistor N18. The control voltage GP in this example is generated at the output of the operational amplifier OP1 in the bandgap voltage reference generator, and therefore produces a current in transistor P7 having a PTAT characteristic. Transistors N19 and N21 are connected in series between ground and a PMOS transistor P8, having a gate connected to the control voltage GC in this example is generated by the CTAT reference circuit 101, and therefore produces a current in transistor P8 having a CTAT characteristic. The gate of transistor N21 is connected to the gate of transistor N20. The gate of transistor N19 is connected to the gate of transistor N18. Also, the gate of transistor N19 is connected to its drain.

Because of the current mirror effect of transistors N21 and N20, the difference between the currents IN19 and IN20 is applied to the drain of NMOS transistor N22 of the current attenuator. A second NMOS transistor N23 is configured in a current mirror relationship with transistor N22. Correction current Icor is generated at the drain of transistor N23, and applied to the intermediate node A of the voltage reference generator. By setting the ratio of the sizes of N23 to N22 to a desired value below 1, and by selecting the resistance of resistor RN20, the magnitude and cutoff threshold of the CTAT correction current Icor can be determined as needed.

Figure 28:
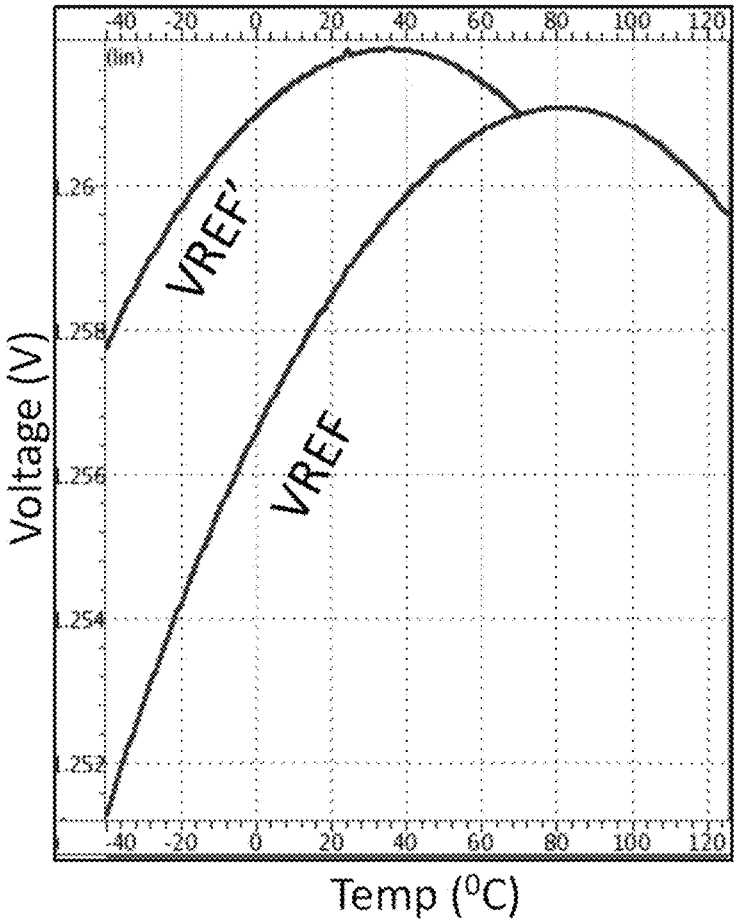
FIG. 28 is a graph of the reference voltage generated by the circuit of FIG. 27, with and without the boosting correction current of FIG. 26.

FIG. 28 is a graph of VREF' simulated using the boosting correction current from the synthesizer 271 in FIG. 27, and VREF simulated without the boosting correction current. As result of the correction current, therefore, the change in reference voltage VREF' in the operating range of −40° C. to +70° C. is about −3 mV, and in the range of about 125° C. to 70° C. variation is about −1 mV. As result of this correction for the shift caused by imbalance in saturation currents in the transistors Q1 and Q2, the reference voltage generator might be more easily corrected to extend the operating temperature range using the techniques described above.

Figure 29:
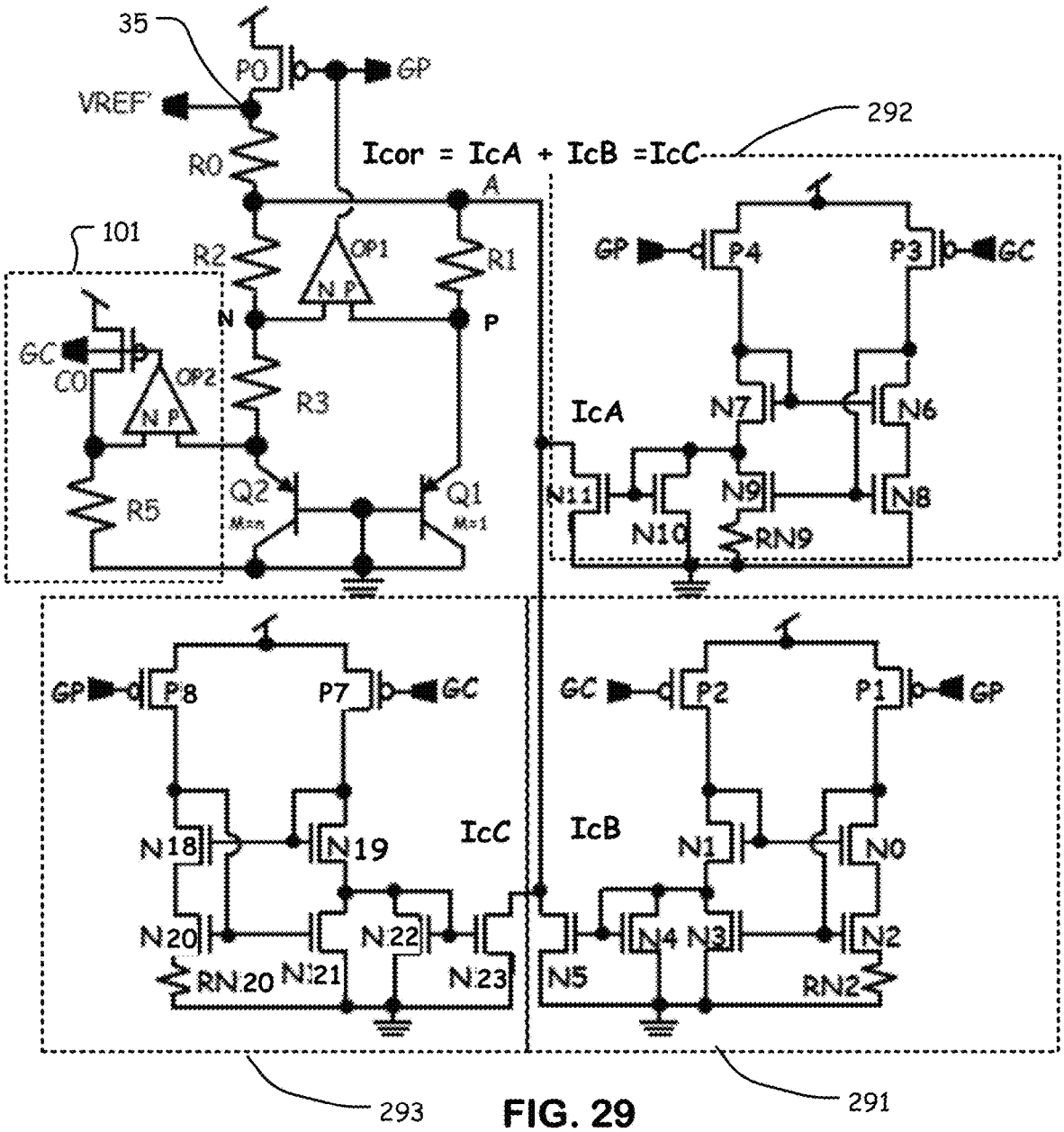
FIG. 29 is a schematic diagram of a voltage reference generator including two current synthesizers which can correct the voltage reference in the lower temperature ranges, and in the higher temperature ranges, and a current synthesizer to produce a boosting correction current as described in FIG. 26.

FIG. 29 is a diagram of a voltage reference generator combining the technologies described with reference to FIGS. 15 and 27. The circuit includes a boosting correction current synthesizer 293 like synthesizer 271 of FIG. 27 to generate the boosting correction current IcC applied to the node A, a boosting correction current synthesizer 292 like synthesizer 151 of FIG. 15 to generate boosting correction current IcA, and a boosting current synthesizer 291 like synthesizer 152 of FIG. 15 to generate the boosting correction current IcB.

Figure 30:
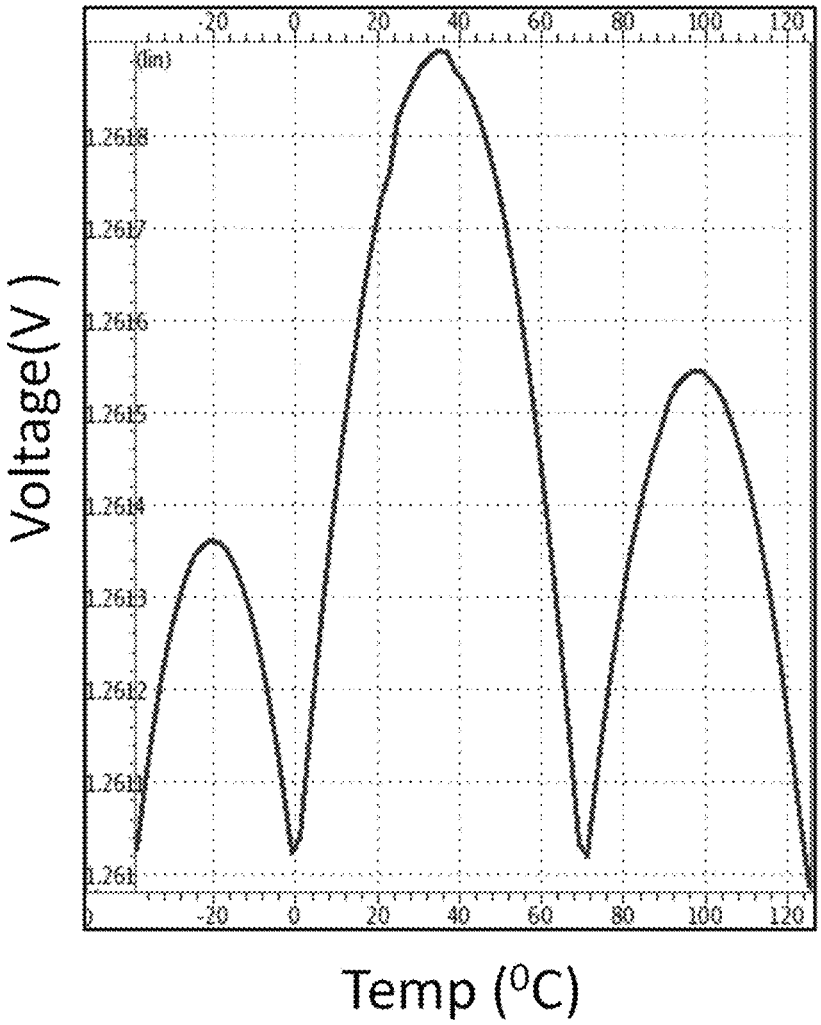
FIG. 30 is a graph of VREF across an extended temperature range using the circuits of FIG. 27, FIG. 15 and FIG. 10.

FIG. 30 is a plot of the reference voltage VREF generated using a circuit like that of FIG. 29 synthesized across the range of about −40° C. to a about 125° C., ranging less than 1 mV across the extended operating temperature range, from a peak of about 1.21688 at around 35° C. to a minimum of about 1.21610 at about 125° C.

Table 2 summarizes the VREF' results of FIGS. 20, 25 and 30.

TABLE 2

| VREF'(v) | FIG. 20 | FIG. 25 | FIG. 30 |
|---|---|---|---|
| 125° C. | 1.24016 | 1.21601 | 1.26099 |
| 70° C. | 1.24018 | 1.21604 | 1.26103 |
| 0° C. | 1.24018 | 1.21604 | 1.26103 |
| −40° C. | 1.24016 | 1.21601 | 1.26099 |
| Δ | 8.1E−04 | 7.0E−04 | 9.0E−04 |

Thus, the technologies described herein can be deployed in a variety of configurations to achieve extended operating temperature ranges for voltage reference generators.

Figure 32:
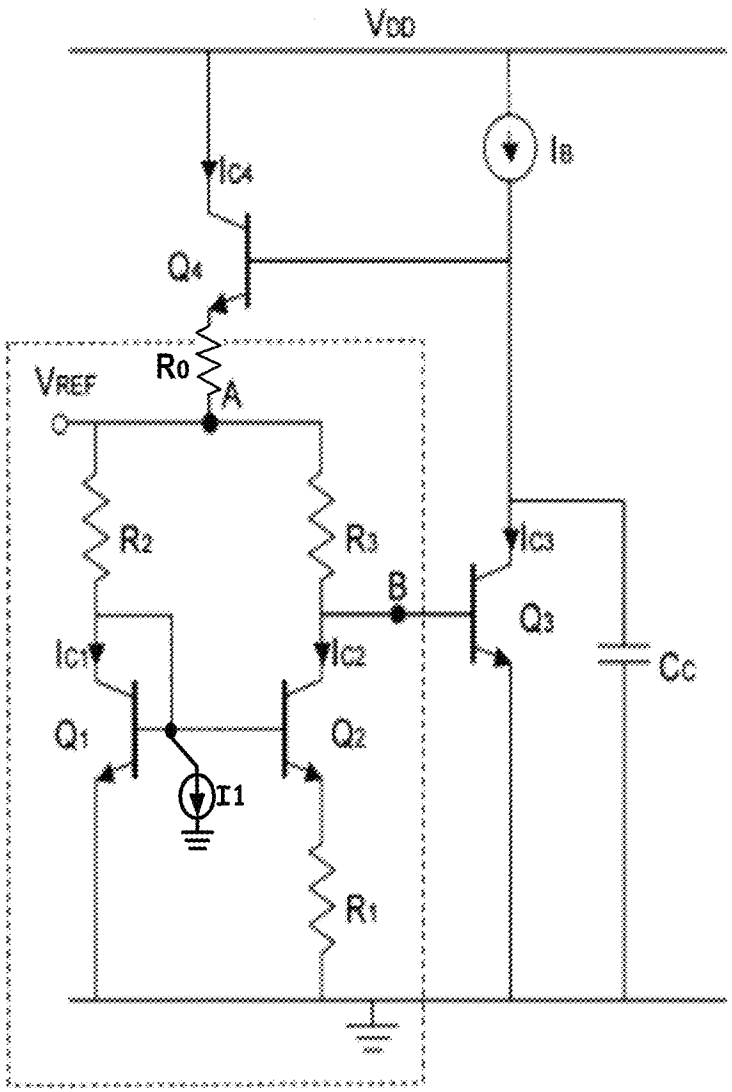
FIG. 32 is a schematic diagram of a voltage reference generator like that of FIG. 31, with a sinking correction current.
Figure 31:
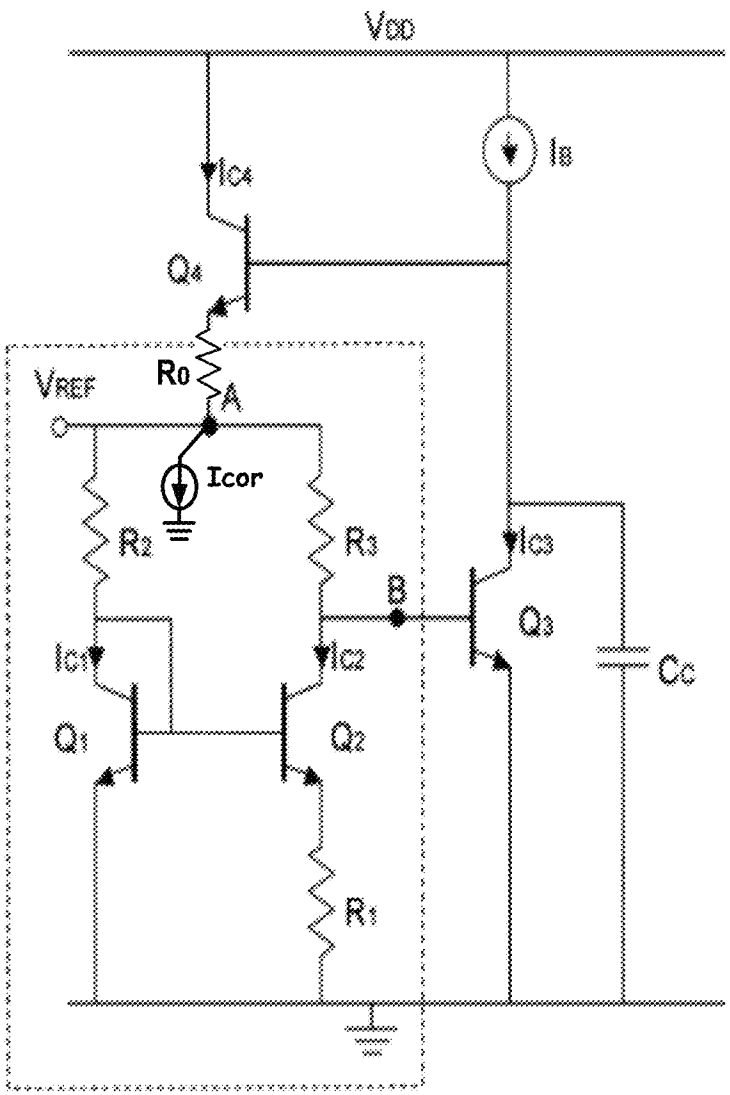
FIG. 31 is a schematic diagram of a voltage reference generator according to another embodiment, with a boosting correction current.

A reference voltage generator using the examples described above can be implemented using other bandgap reference circuits. For example, the circuits shown in FIG. 31 and FIG. 32 show an alternative voltage reference generator circuit. The voltage reference generator circuit of FIGS. 31 and 32 includes a first circuit and a second circuit including PNP transistors Q1 and Q2, respectively, having their gates connected together. The emitter of transistor Q1 is connected to ground, and the emitter of transistor Q2 is connected through a resistor R1 to ground. The base of transistor Q1 is connected to its drain, which conducts the current IC1. Also, the collector of transistor Q1 is connected through a resistor R2 to the intermediate node A, at which the reference voltage VREF is generated. The collector of transistor Q2 is connected through a resistor R3 to intermediate node A. Transistor Q4 is connected from node A to the supply power potential VDD, and conducts current IC4. Transistor Q3 has its base connected to the collector of transistor Q2. A resistor R0 is connected from node A to the emitter of transistor Q4. The drain of transistor Q4 is connected to the power supply potential VDD, and conducts current IC4. Transistor Q3 has its base connected to the collector of transistor Q2. The emitter of transistor Q3 is connected to ground. The collector of transistor Q3 is connected across capacitor Cc to ground. Also, the collector of transistor Q3 receives a reference current from a current source IB. The base of transistor Q4 is connected to the drain of transistor Q3.

The circuits of FIG. 31 and FIG. 32 generate a reference voltage VREF by maintaining the condition in which the voltage ΔVBE produced by current IC2 in transistor Q2 times the resistance of R1, plus the base emitter voltage VBE of transistor Q2 is equal to the base emitter voltage of transistor Q1. Feedback is provided by the circuit including transistor Q3 which controls the charge on the capacitor Cc to maintain the current IC4 through transistor Q4 and R1 at levels required to satisfy this condition. A boosting correction current Icor can be added at node A using the techniques described above. Also, as illustrated in FIG. 32, the circuit of FIG. 31 can be modified by adding a sinking correction current at the base of transistor Q1 using the techniques described above. Also, combinations of boosting correction current and sinking correction current can be used in the reference generators of FIG. 31 and FIG. 32.

Also, voltage reference generators can be implemented using PN junction devices other than bipolar transistors, such as diodes or MOS transistors, for some embodiments of the technology.

In a given implementation using technologies described herein, the slopes and cross points of the Icor boosting correction current and of the I1 sinking correction current can be tuned using these current synthesis techniques. Other embodiments can deploy other types of current synthesis circuits to generate desired correction currents, Icor and I1, characteristics.

Embodiments of the technology described herein implement the current synthesizer's using a current subtraction and current attenuator technique. Other types of current synthesizers can be utilized to produce the boosting correction current and sinking correction current in other embodiments.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A reference voltage circuit for producing a reference voltage, comprising:

first circuit including a first PN junction device and a first resistor connected in series between a power supply node and a first node, and a second resistor connected between the first node and an intermediate node, and a third resistor connected between the intermediate node and a reference voltage output node;

a second circuit including a second PN junction device connected between the power supply node and a second node and a fourth resistor connected between the second node and the intermediate node;

a feedback current source configured to supply a feedback current to the reference voltage output node, the feedback current divided between the first circuit and the second circuit, the feedback current having a magnitude controlled by a current control signal;

a feedback circuit connected to one or both of the first and second nodes to generate the current control signal to cause voltage across the first resistor to offset changes in voltage across the first PN junction device; and a current source configured to supply a correction current at the intermediate node to boost current in the third resistor at operating temperatures on a first side of a threshold, and to turn off at operating temperatures on an opposite, second side of the threshold.

2. The reference voltage circuit of claim 1, including a second current source to sink a second correction current from the second node, the second correction current having a magnitude increasing with increasing operating temperatures across a range of temperatures to offset mismatches in saturation current of the first and second PN junction devices.

3. The reference voltage circuit of claim 1, wherein the current source includes a circuit to generate a correction current component, the correction current component having a magnitude decreasing with increasing operating temperatures across a range of temperatures to offset mismatches in saturation current of the first and second PN junction devices.

4. The reference voltage circuit of claim 1, wherein the correction current decreases with increasing temperature up to the threshold, and turns off above the threshold.

5. The reference voltage circuit of claim 1, wherein the correction current decreases with decreasing temperature down to the threshold, and turns off below the threshold.

6. The reference voltage circuit of claim 1, wherein the current source includes a first circuit which generates a decreasing boost current component that decreases with increasing temperature up to the threshold, and turns off above the threshold, and a second circuit which generates an increasing boost current component that increases with increasing temperature above a second threshold, the second threshold being above the first mentioned threshold, and the correction current is a combination of the increasing and decreasing boost current components.

7. The reference voltage circuit of claim 1, wherein the current source includes:

a first circuit which generates a decreasing boost current component that decreases with increasing temperature up to the threshold, and turns off above the threshold;

a second circuit which generates an increasing boost current component that increases with increasing temperature above a second threshold, the second threshold being above the first mentioned threshold; and a third circuit to generate a correction current component having a magnitude decreasing with increasing operating temperatures across a range of temperatures to offset mismatches in saturation current of the first and second PN junction devices, wherein:

the correction current is a combination of the increasing and decreasing boost current components and the correction current component.

8. The reference voltage circuit of claim 7, including a second current source to sink a second correction current from the second circuit, the second correction current having a magnitude increasing with increasing operating temperatures across a range of temperatures to offset mismatches in saturation current of the first and second PN junction devices.

9. The reference voltage circuit of claim 1, wherein the current source comprises a current subtractor circuit to generate the correction current in response to a difference between a PTAT current and a CTAT current.

10. The reference voltage circuit of claim 1, wherein the current source comprises a circuit to generate a PTAT current responsive to the feedback circuit, a circuit to generate a CTAT current responsive to one of the first and second PN junction devices, a current subtractor to generate a difference current, and a current attenuator to generate the correction current based on the difference current.

11. The reference voltage circuit of claim 1, wherein the correction current does not change current magnitudes in the first and second PN junction devices.

12. The voltage reference circuit of claim 1, wherein the PN junction devices are transistors.

13. A reference voltage circuit for producing a reference voltage, comprising:

first circuit including a first transistor and a first resistor connected in series between a power supply node and a first node, and a second resistor connected between the first node and an intermediate node, and a third resistor connected between the intermediate node and a reference voltage output node;

a second circuit including a second transistor having a first terminal connected to a first terminal of the first transistor, the second transistor connected between the power supply node and a second node and a fourth resistor connected between the second node and the intermediate node;

a third transistor configured to supply a feedback current to the reference voltage output node, the feedback current divided between the first circuit and the second circuit, the feedback current having a magnitude controlled by a control signal;

an operational amplifier having inputs connected to the first and second nodes and an output connected to a control terminal of the third transistor, to generate the control signal to cause voltage across the first resistor to offset changes in voltage across a PN junction of the first transistor; and a current source configured to supply a correction current at the intermediate node to boost current in the third resistor at operating temperatures on a first side of a threshold, and to turn off at operating temperatures on an opposite, second side of the threshold.

14. The voltage reference circuit of claim 13, including a fifth resistor connected between a fourth node and a second terminal of the first transistor, a fourth transistor connected configured to supply current across the fifth resistor, and a second operational amplifier having a first input connected to the fourth node and a second input connected to a third terminal of the first transistor, the output of the second operational amplifier being connected to a control terminal of the fourth transistor, and wherein the current source is responsive to the output of the second operational amplifier and to the output of the first mentioned operational amplifier.

15. The reference voltage circuit of claim 14, including a second current source to sink a second correction current from the second node, the second correction current having a magnitude responsive to the output of the second operational amplifier and to the output of the first mentioned operational amplifier.

16. The reference voltage circuit of claim 14, wherein the current source comprises a circuit to generate a PTAT current responsive to the output of the first mentioned operational amplifier, a circuit to generate a CTAT current responsive to a second mentioned operational amplifier, a current subtractor to generate a difference current between the PTAT current and the CTAT current, and a current attenuator to generate the correction current based on the difference current.

17. The reference voltage circuit of claim 13, wherein the current source includes a circuit to generate a correction current component, the correction current component having a magnitude decreasing with increasing operating temperatures across a range of temperatures to offset mismatches in saturation current of the first and second transistors.

18. The reference voltage circuit of claim 13, wherein the current source includes a circuit which generates a decreasing boost current component that decreases with increasing temperature up to the threshold, and turns off above the threshold, and a circuit which generates an increasing boost current component that increases with increasing temperature above a second threshold, the second threshold being above the first mentioned threshold, and the correction current is a combination of the increasing and decreasing boost current components.

19. The reference voltage circuit of claim 13, wherein the current source includes:

a circuit which generates a decreasing boost current component that decreases with increasing temperature up to the threshold, and turns off above the threshold;

a circuit which generates an increasing boost current component that increases with increasing temperature above a second threshold, the second threshold being above the first mentioned threshold; and a circuit to generate a correction current component having a magnitude decreasing with increasing operating temperatures across a range of temperatures to offset mismatches in saturation current of the first and second transistors, wherein:

the correction current is a combination of the increasing and decreasing boost current components and the correction current component.

20. The reference voltage circuit of claim 13, wherein a reference voltage at the reference voltage output node varies by less than 1 mV across a temperature range from −40° C. to +125° C.

* * * * *